US008519931B2

(12) United States Patent
Wang

(10) Patent No.: US 8,519,931 B2
(45) Date of Patent: Aug. 27, 2013

(54) SOURCE DRIVER FOR DISPLAY PANEL AND DRIVE CONTROL METHOD

(75) Inventor: Haisong Wang, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 657 days.

(21) Appl. No.: 12/473,491

(22) Filed: May 28, 2009

(65) Prior Publication Data

US 2009/0295777 A1 Dec. 3, 2009

(30) Foreign Application Priority Data

May 30, 2008 (JP) ..... 2008-142462

(51) Int. Cl.
*G09G 3/36* (2006.01)

(52) U.S. Cl.
USPC ..... 345/96

(58) Field of Classification Search
USPC ..... 345/96
See application file for complete search history.

(56) References Cited

U.S. PATENT DOCUMENTS

| | | | | |
|---|---|---|---|---|
| 6,331,846 | B1 * | 12/2001 | Nakao | 345/96 |
| 7,319,450 | B2 | 1/2008 | Choi | |
| 7,893,909 | B2 * | 2/2011 | Sung | 345/96 |
| 7,936,328 | B2 | 5/2011 | Furihata et al. | |
| 8,068,080 | B2 * | 11/2011 | Nishimura | 345/96 |
| 2002/0039096 | A1 | 4/2002 | Katsutani | |
| 2002/0041274 | A1 * | 4/2002 | Watanabe | 345/204 |
| 2004/0108988 | A1 * | 6/2004 | Choi | 345/96 |
| 2006/0017680 | A1 * | 1/2006 | Chen et al. | 345/96 |

FOREIGN PATENT DOCUMENTS

| | | |
|---|---|---|
| JP | 11-003070 | 1/1999 |
| JP | 11-184422 | 7/1999 |
| JP | 2002-108303 | 4/2002 |
| JP | 2004-310033 | 11/2004 |
| JP | 2007-148204 | 6/2007 |
| JP | 2007-219200 | 8/2007 |

OTHER PUBLICATIONS

Japanese Office Action dated Oct. 2, 2012.

* cited by examiner

*Primary Examiner* — Jonathan Boyd
(74) *Attorney, Agent, or Firm* — Volentine & Whitt, PLLC

(57) ABSTRACT

A source driver and drive control method that cancel offset voltages and enable quality display when a vertical synchronization signal is not fed to the source driver. A source driver receives a horizontal synchronization signal of an image signal, and a binary control signal which varies in two values in synchronization with the horizontal synchronization signal and in which start values of adjacent frames of the image signal are different, excluding a vertical synchronization signal of the image signal, to apply a drive voltage to source signal lines of a display panel. In the source driver, the vertical cycle of the image signal is analyzed based on the binary control signal; a pseudo vertical synchronization signal is generated based on the vertical cycle; and a cancel operation of an offset voltage component of the drive voltage is performed based on the pseudo vertical synchronization signal.

9 Claims, 18 Drawing Sheets

FIRST FRAME

SECOND FRAME

THIRD FRAME

FOURTH FRAME

HORIZONTAL SYNC SIGNAL 4n + 3 IN BLANKING PERIOD

HORIZONTAL SYNC SIGNAL 4n + 2 IN BLANKING PERIOD

HORIZONTAL SYNC SIGNAL 4n + 1 IN BLANKING PERIOD

HORIZONTAL SYNC SIGNAL 4n IN BLANKING PERIOD
ONE PIXEL
POL
OSC
FIRST FRAME
BLANKING PERIOD
SECOND FRAME
THIRD FRAME
FOURTH FRAME
FIFTH FRAME

HORIZONTAL SYNC SIGNAL 4n + 3 IN BLANKING PERIOD

HORIZONTAL SYNC SIGNAL 4n + 2 IN BLANKING PERIOD

HORIZONTAL SYNC SIGNAL 4n + 1 IN BLANKING PERIOD

HORIZONTAL SYNC SIGNAL 4n IN BLANKING PERIOD

FIG.16A

HORIZONTAL SYNC SIGNAL 4n + 2 IN BLANKING PERIOD

| | ONE PIXEL | POL | OSC |
|---|---|---|---|
| FIRST FRAME | +A | L | L |
| | +B | H | L |
| | −A | L | H |
| | −B | H | H |
| BLANKING PERIOD | +A | L | L |
| | +B | H | L |
| | −B | H | H |
| SECOND FRAME | −A | L | H |
| | +B | H | L |
| | +A | L | L |
| BLANKING PERIOD | −B | H | H |
| | −A | L | H |
| | −A | L | H |
| THIRD FRAME | −B | H | H |
| | +A | L | L |
| | +B | H | L |
| BLANKING PERIOD | −A | L | H |
| | −B | H | H |
| | +B | H | L |
| FOURTH FRAME | +A | L | L |
| | −B | H | H |
| | −A | L | H |
| BLANKING PERIOD | +B | H | L |
| | +A | L | L |
| | −A | L | H |
| FIFTH FRAME | −B | H | H |
| | +A | L | L |
| | +B | H | L |

FIG.16B

HORIZONTAL SYNC SIGNAL 4n IN BLANKING PERIOD

| | ONE PIXEL | POL | OSC |
|---|---|---|---|
| FIRST FRAME | +A | L | L |
| | +B | H | L |
| | −A | L | H |
| | −B | H | H |
| BLANKING PERIOD | +A | L | L |
| | +B | H | L |
| | −A | L | H |
| | −B | H | H |
| SECOND FRAME | +B | H | L |
| | +A | L | L |
| | −B | H | H |
| | −A | L | H |
| BLANKING PERIOD | +B | H | L |
| | +A | L | L |
| | −B | H | H |
| | −A | L | H |
| THIRD FRAME | −A | L | H |
| | −B | H | H |
| | +A | L | L |
| | +B | H | L |
| BLANKING PERIOD | −A | L | H |
| | −B | H | H |
| | +A | L | L |
| | +B | H | L |
| FOURTH FRAME | −B | H | H |
| | −A | L | H |
| | +B | H | L |
| | +A | L | L |
| BLANKING PERIOD | −B | H | H |
| | −A | L | H |
| | +B | H | L |
| | +A | L | L |
| FIFTH FRAME | −A | L | H |
| | −B | H | H |
| | +A | L | L |
| | +B | H | L |

HORIZONTAL SYNC SIGNAL 4n + 3 IN BLANKING PERIOD

HORIZONTAL SYNC SIGNAL 4n + 1 IN BLANKING PERIOD

HORIZONTAL SYNC SIGNAL 4n IN BLANKING PERIOD
ONE PIXEL
POL
OSC
FIRST FRAME
BLANKING PERIOD
SECOND FRAME
THIRD FRAME
FOURTH FRAME
FIFTH FRAME

FIG.18

HORIZONTAL SYNC SIGNAL 4n + 2 IN BLANKING PERIOD

| | ONE PIXEL | POL | OSC |
|---|---|---|---|
| FIRST FRAME | +A | L | L |
| | −A | L | H |
| | +B | H | L |
| | −B | H | H |
| BLANKING PERIOD | | | |
| SECOND FRAME | +A | L | L |
| | −A | L | H |
| | +B | H | L |
| | −B | H | H |
| | +A | L | L |
| | −A | L | H |
| BLANKING PERIOD | | | |
| THIRD FRAME | +B | H | L |
| | −B | H | H |
| | −A | L | H |
| | +A | L | L |
| | −B | H | H |
| | +B | H | L |
| BLANKING PERIOD | | | |
| FOURTH FRAME | −A | L | H |
| | +B | L | L |
| | −B | H | H |
| | +B | H | L |
| | −A | L | H |
| | +A | L | L |
| BLANKING PERIOD | | | |
| FIFTH FRAME | −B | H | H |
| | +A | H | L |
| | −A | L | H |
| | +A | L | L |
| | −B | H | H |
| | +B | H | L |

SOURCE DRIVER FOR DISPLAY PANEL AND DRIVE CONTROL METHOD

BACKGROUND OF THE INVENTION

1. Field of the Invention

The present invention relates to a source driver for a display panel such as an active matrix liquid crystal panel and a drive control method therefor.

2. Description of the Related Art

It is known that AC driving is required in order to assure long-term reliability of a liquid crystal panel. Accordingly, in a conventional active matrix liquid crystal display device, the polarity of the drive voltage applied by a source driver between the electrodes of a liquid crystal element of each cell (pixel) of the liquid crystal panel is inverted for each frame of the image signal (see Japanese Laid-open Patent Application No. 2002-108303). Rather than simultaneously setting all cells of the liquid crystal panel to the same polarity, there is used a dot inversion drive-scheme, in which the cells in adjacent columns and rows become inverted in polarity, or a two-line dot inversion method, in which every two lines are inverted in the rows. In order to generate such a positive polarity and negative polarity a drive voltage, the source driver is provided with two differential amplifiers (operational amplifiers) using odd-numbered source signal lines and even-numbered source signal lines of a liquid crystal panel, e.g., two N-channel MOS transistors and two P-channel MOS transistors, and drive voltages of mutually opposite polarity that reverse polarity for each frame are generated at the output terminal of the source driver connected to the odd-numbered source signal line and the output terminal of the source driver connected to the even-numbered source signal line. However, an offset voltage component is ordinarily included in the drive voltages because of characteristic differences in manufacturing the transistors of the two differential amplifier circuits.

Nonuniform display occurs or image quality is otherwise negatively affected when an offset voltage is included in the drive voltage. Therefore, the offset voltage is canceled (see Japanese Laid-open Patent Application No. 2002-108303). For example, the drive voltage outputted to the odd-numbered output terminals is offset in the following manner: one of two transistors of one differential amplitude circuit of two differential amplitude circuits is switched on in the first frame of four consecutive frames, and a positive polarity drive voltage that includes an offset voltage +A is generated; one transistor of the other differential amplifier circuit is switched on in the second frame, and a negative polarity drive voltage that includes an offset voltage +B is generated; the other transistor of one of the differential amplifier circuits is switched on in the third frame, and a positive polarity drive voltage that includes an offset voltage −A is generated; and the other transistor of the other differential amplifier circuit is switched on in the fourth frame, and a negative polarity drive voltage that includes an offset voltage −B is generated. The offset voltages in the four frames cancel each other in the manner of +A+B−A−B=0.

In the conventional liquid crystal display device described above, a vertical synchronization signal of an image signal is required to be inputted to a source driver in order to generate an AC drive control signal or another control signal for accurately detecting between-frames and controlling the connecting and switching between odd- and even-numbered output terminals and the outputs of two differential amplifier circuits. However, the vertical synchronization signal is sometimes not fed to the source driver depending on the existing liquid crystal panel, and there is difficulty in accurately detecting between-frames.

SUMMARY OF THE INVENTION

In view of the foregoing, an object of the present invention is to provide a source driver for a display panel and a control method for driving the same, whereby it is possible to cancel offset voltages and obtain good display quality even when a vertical synchronization signal is not fed to the source driver.

The drive control method of the present invention is a method in a source driver for receiving from a timing controller a horizontal synchronization signal of an image signal and a binary control signal of which a value varies in two values in synchronization with the horizontal synchronization signal and in which start values of adjacent frames of the image signal are different, excluding a vertical synchronization signal of the image signal, so as to apply drive voltages to a plurality of source signal lines of a display panel, the drive control method comprising: an analysis step of analyzing the vertical cycle of the image signal on the basis of the binary control signal; a pseudo vertical synchronization signal generation step of generating a pseudo vertical synchronization signal on the basis of the vertical cycle; and an offset cancel step of performing a cancel operation of an offset voltage component of each of the drive voltages on the basis of the pseudo vertical synchronization signal.

The source driver of the present invention is a source driver for receiving from a timing controller a horizontal synchronization signal of an image signal and a binary control signal of which a value varies in two values in synchronization with the horizontal synchronization signal and in which start values of adjacent frames of the image signal are different, excluding a vertical synchronization signal of the image signal, so as to apply drive voltages to a plurality of source signal lines of a display panel, the source driver comprising: an analysis portion which analyzes the vertical cycle of the image signal on the basis of the binary control signal; a pseudo vertical synchronization signal generation portion which generates a pseudo vertical synchronization signal on the basis of the vertical cycle; and an offset cancel portion which performs a cancel operation of an offset voltage component of each of the drive voltages on the basis of the pseudo vertical synchronization signal.

According to the present invention, a pseudo vertical synchronization signal can be generated without a vertical synchronization signal of the image signal being fed to the source driver, and the offset voltage component of the drive voltage can be canceled in accordance with the pseudo vertical synchronization signal. Accordingly, a good display quality can be obtained without nonuniform display or other reduction in image quality by an offset voltage.

BRIEF DESCRIPTION OF THE DRAWINGS

FIGS. 16A and 16B are diagrams showing the variation of the offset cancel control signal OSC and the variation of the offset voltage when the frame identification signal is used as the pseudo vertical synchronization signal using the dot inversion drive scheme;

FIG. 18 is a diagram showing the variation of the offset cancel control signal OSC and the variation of the offset voltage when one frame period is used as the pseudo vertical synchronization signal using the two-line dot inversion drive scheme.

DETAILED DESCRIPTION OF THE INVENTION

Embodiments of the present invention are described in detail below with reference to the drawings.

Figure 1:
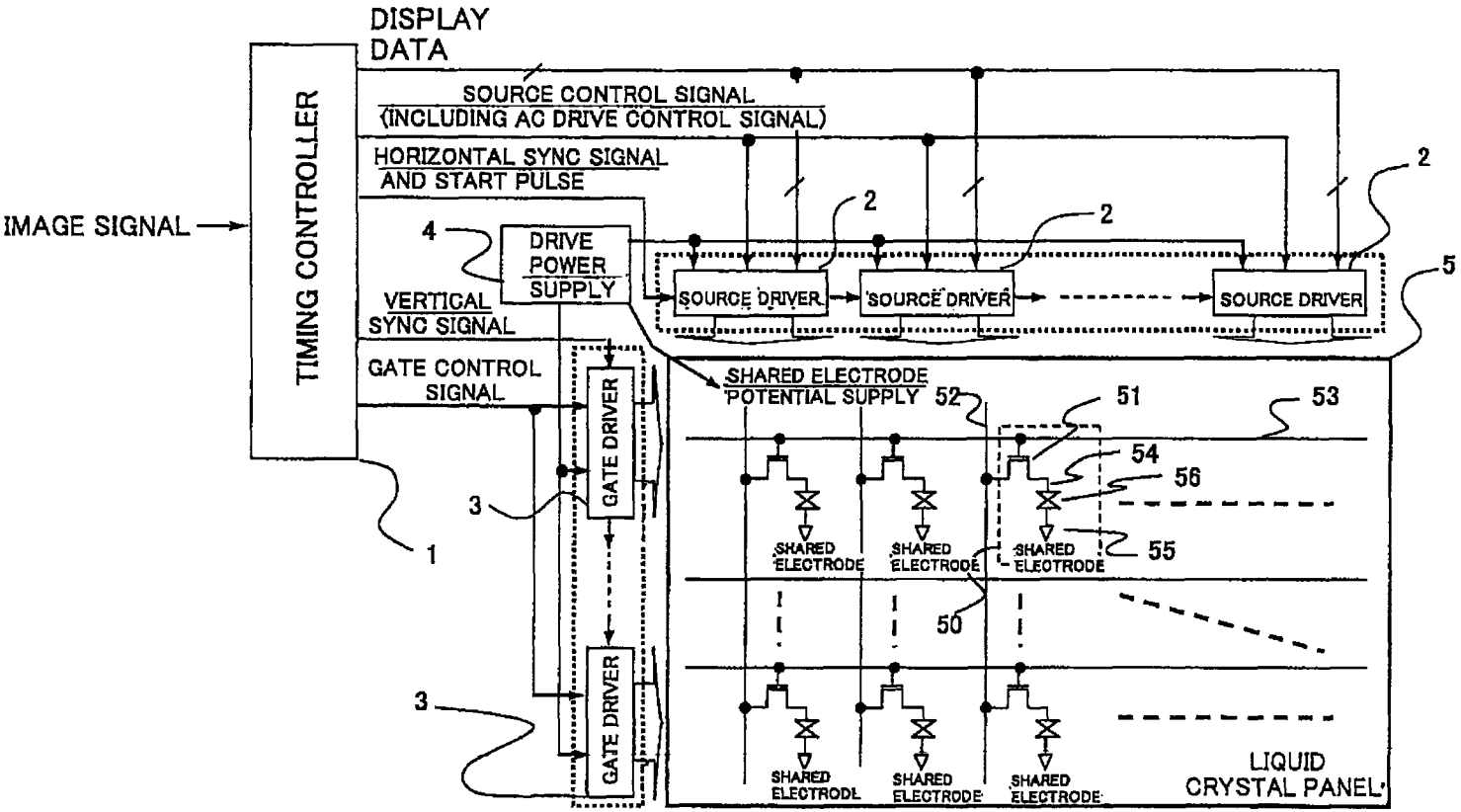
FIG. 1 is a block diagram showing the configuration of a liquid crystal display device in which the present invention has been applied.

FIG. 1 shows a liquid crystal display device as an example of the present invention. The liquid crystal display device is provided with a timing controller 1, a plurality of source drivers 2, a plurality of gate drivers 3, a drive power supply 4, and a TFT liquid crystal panel 5.

The TFT liquid crystal panel 5 is provided with a plurality of source signal lines 52 extending in the column direction and a plurality of gate signal lines 53 extending in the row direction, and cells (pixels) are formed by the intersecting portions between the source signal lines 52 and the gate signal lines 53. Each cell is schematically shown in FIG. 1 and is provided with a TFT (thin-film transistor) 51 and a liquid crystal element 56. The source of the TFT 51 is connected to the source signal line 52, and the gate is connected to the gate signal line 53. One end (element electrode) 54 of the liquid crystal element 56 is connected to the drain of the TFT 51, and the other end (shared electrode) 55 of the liquid crystal element 56 is connected in a shared configuration to a shared electrode potential.

The timing controller 1 receives an image signal provided by a graphic processor or another external circuit, outputs a vertical synchronization signal to each of the gate drivers 3 in accordance with the image signal, and outputs a source control signal and a horizontal synchronization signal to the source drivers 2 in synchronization with the vertical synchronization signal. A later-described AC drive control signal POL (a binary control signal) is included as a source control signal. The timing controller 1 converts the image signal to digital data of each display line and uses the converted signal as RGB display data (data indicating brightness), sequentially provides the display data to the source drivers 2, and outputs the gate control signal to the gate drivers 3 for generating a scan signal.

The gate drivers 3 are composed of identical IC chips. One among the plurality of gate signal lines 53 of the liquid crystal panel 5 is selected in accordance with the gate control signal, and a scan signal based on the output voltage of the drive power supply 4 is outputted to the selected gate signal line.

The source drivers 2 are composed of identical IC chips. A gradation display voltage that corresponds to the display data and that has been generated on the basis of a reference voltage obtained from the drive power supply 4 is selected and applied to the source signal lines 52 of the liquid crystal panel 5, whereby the TFTs 51 of the cells on the line 53 to which the scan signal is fed by the gate drivers 3 are switched on and voltage is applied to the liquid crystal element 56. Therefore, the light transmittance of the liquid crystal element 56 varies. This variation is generated in the liquid crystal element 56 of every cell to thereby project an image on the liquid crystal panel 5.

The voltage applied to the liquid crystal element 56 is an electric potential difference between the element electrode 54 and the shared electrode 55, and the liquid crystal panel 5 must apply an AC voltage to the liquid crystal element 56 in order to assure long-term reliability. In other words, the output of the gate drivers 3 switches on the TFTs 51, and the output of the source drivers 2 have a positive or negative voltage that is applied through the element electrodes 54 to the shared electrodes 55. In this manner, the voltage applied to the liquid crystal elements 56 can be converted to AC and used for driving.

Figure 2:
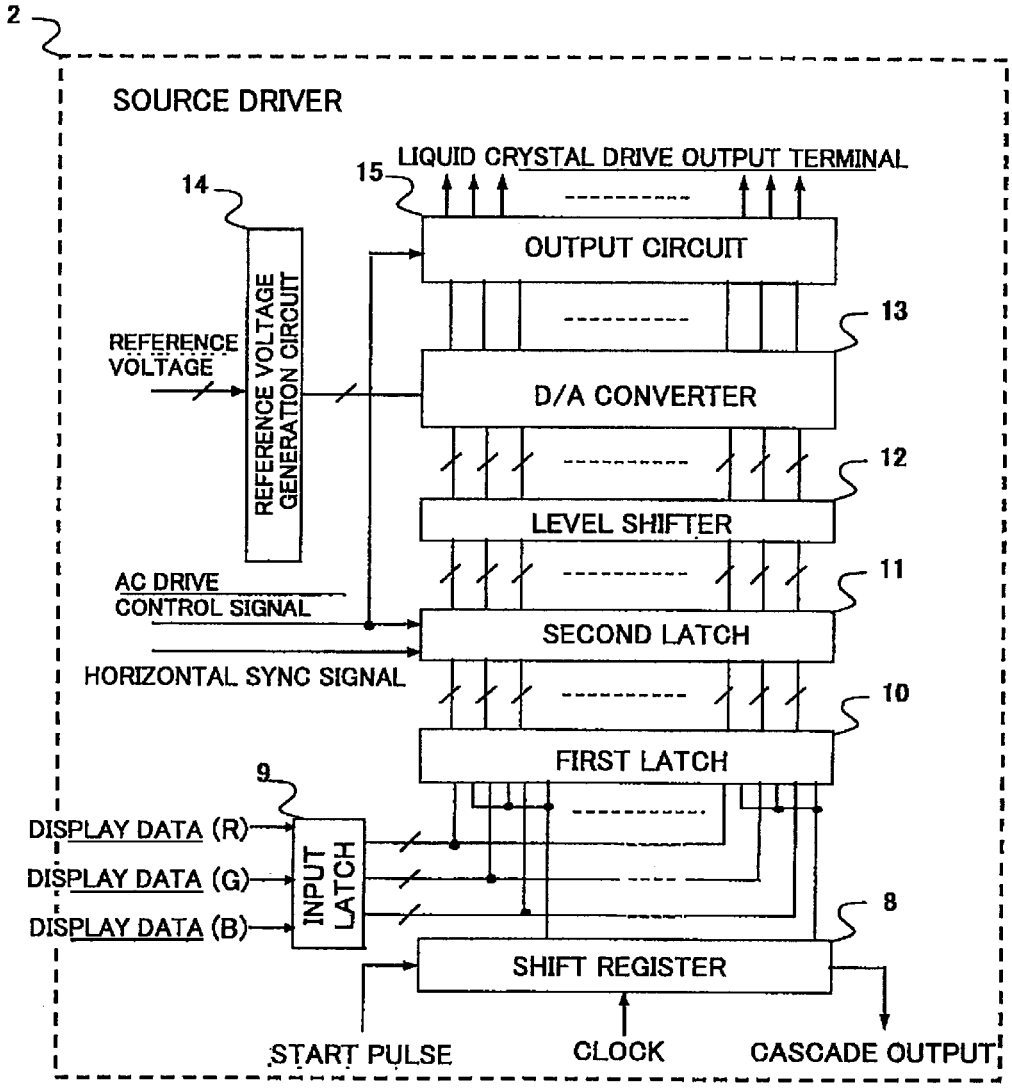
FIG. 2 is a block diagram showing the configuration of the source driver in the device of FIG. 1.

A source driver 2 is composed of a shift register 8, a display data latch 9, a first latch 10, a second latch 11, a level shifter 12, a reference voltage generation circuit 14, a D/A converter 13, and an output circuit 15, as shown in FIG. 2.

The display data (R, G, B) of an inputted digital signal is sequentially stored in the first latch 10 on the basis of the operation of the shift register 8 in a time-division configuration. The operation of the shift register B is based on the start pulse and clock from the timing controller 1. The second latch 11 holds display data from the first latch 10, and outputs the display data in unison to the D/A converter 13 in response to a horizontal synchronization signal. The reference voltage generation circuit 14 generates numerous reference voltages on the basis of voltage supplied from the drive power source 4. The D/A converter 13 outputs to the output circuit 15 a gradation display voltage that corresponds to the digital display data on the basis of numerous analog voltages generated by the reference voltage generation circuit 14. The output circuit 15 presents the gradation display voltage to the liquid crystal drive output terminal in accordance with the AC drive control signal, and the voltage is applied to the element electrodes 54 via the source signal lines 52 and the TFTs 51. The voltage generated in the liquid crystal drive output terminal is converted to AC. In the AC conversion, the voltage switches back and forth for each frame between a positive polarity voltage (positive voltage) and a negative polarity voltage (negative voltage). Accordingly, although not depicted in FIG. 2, an output AC conversion switch is inserted between the second latch 11 and the level shifter 12 and an output AC conversion switch is also included in the output circuit 15.

Figure 3:
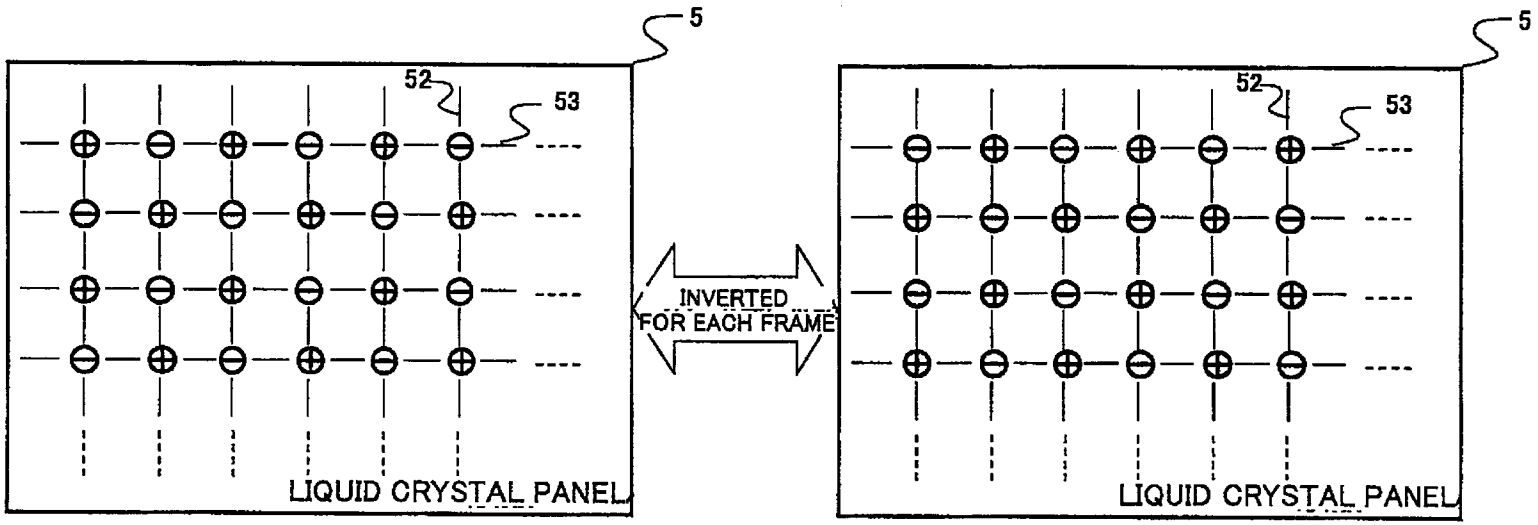
FIG. 3 is a diagram showing the polarity of the drive voltage of each cell of two consecutive frames in the case of the dot inversion drive scheme.
Figure 4:
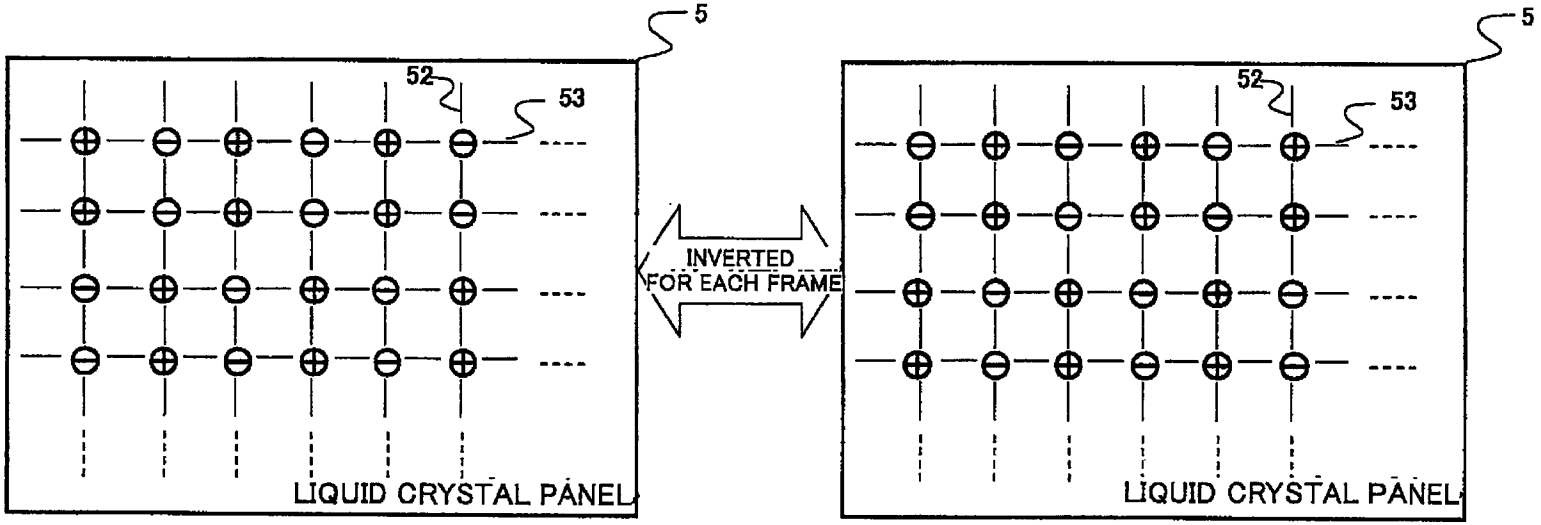
FIG. 4 is a diagram showing the polarity of the drive voltage of each cell of two consecutive frames in the case of the 2-line-dot inversion drive scheme.

FIG. 3 shows the AC conversion in the dot inversion drive scheme, and FIG. 4 shows the AC conversion in the two-line dot inversion drive scheme. In the case of the dot inversion drive scheme, a positive polarity + and a negative polarity − in one frame are alternately arranged for each upper/lower row (line) and for each left/right column. In the next frame, the polarities + and − are inverted and this sequence is repeated for each frame. With these two methods, the even-numbered output terminals in the source drivers 2 output a negative polarity voltage when the odd-numbered output terminals output a positive polarity voltage. Conversely, the even-numbered output terminals output a positive polarity voltage when the odd-numbered output terminals output a negative polarity voltage.

Figure 5:
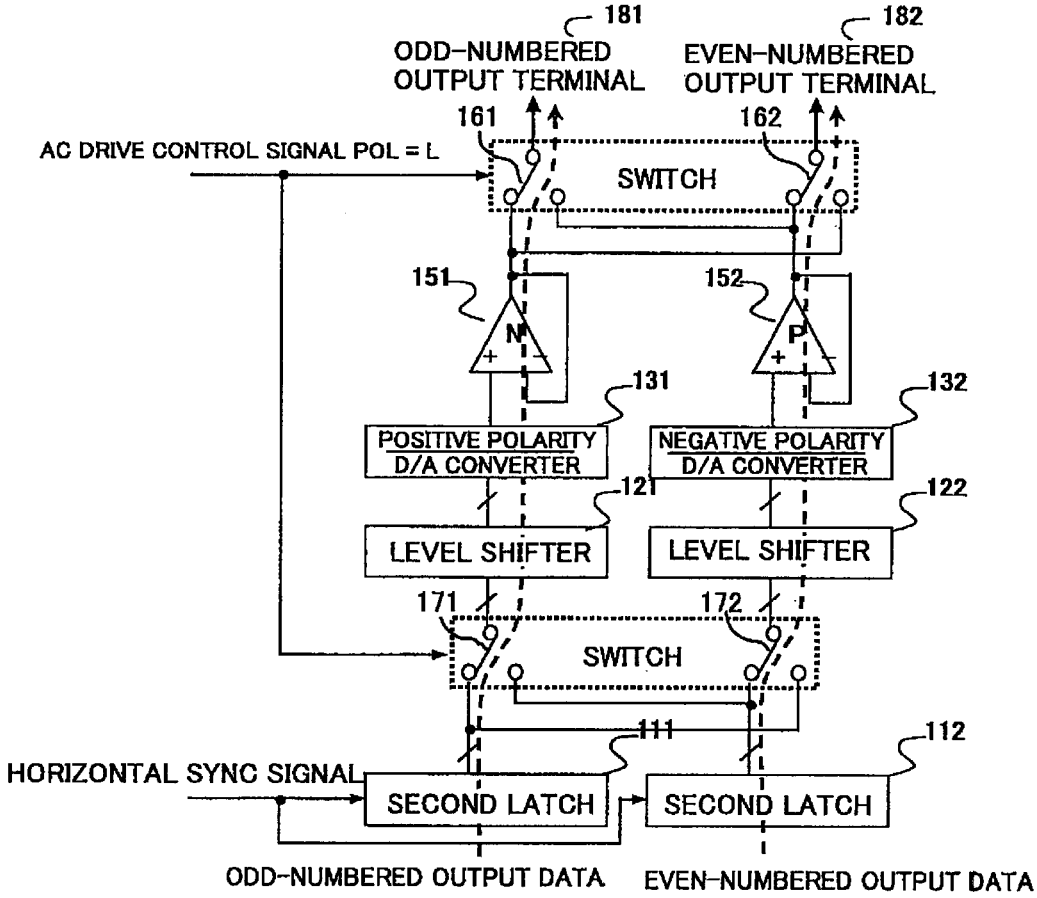
FIG. 5 is a diagram showing a specific configuration of the portion that includes the switches related to the odd- and even-numbered output terminals of the source driver, and the flow of signals in a state in which the switches are switched.
Figure 6:
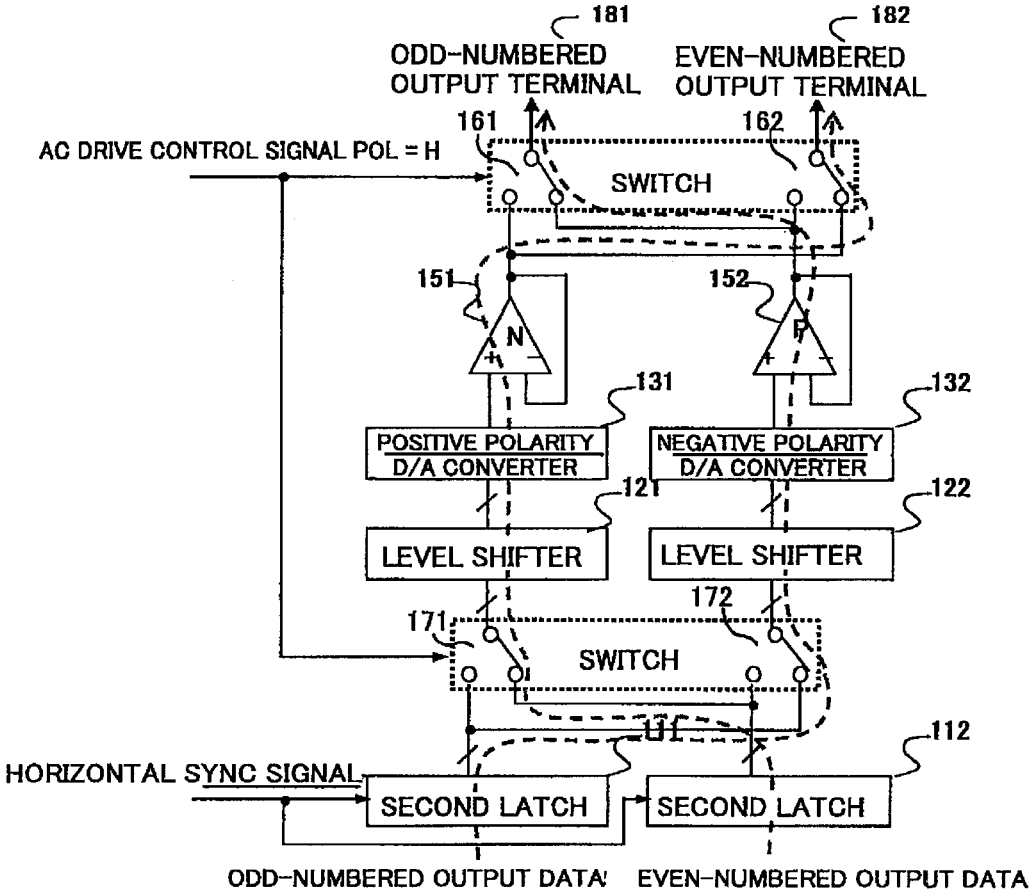
FIG. 6 is a diagram showing a specific configuration of the portion that includes the switches related to the odd- and even-numbered output terminals of the source driver, and the flow of signals in a state in which the switches are switched.

FIGS. 5 and 6 show in detail the portion related to a single odd-numbered output terminal 181 and a single even-numbered output terminal 182 in the source driver 2. Arranged in the odd-numbered output terminal 181 side are a second latch 111, a switch 171, a level shifter 121, a positive polarity D/A converter 131, and a voltage follower 151 and an AC converter switch 161 as an output circuit 15. Arranged in the even-numbered output terminal 182 side are a second latch 112, a switch 172, a level shifter 122, a negative polarity D/A converter 132, and a voltage follower 152 and an AC converter switch 162 as an output circuit 15. The switches 171, 172 operate in coordination with the AC drive control signal POL, and the AC converter switches 161, 162 also operate in coordination. Since the AC drive control signal POL is a low level L, the switch 172 relays and feeds the output data of the second latch 112 to the level shifter 122 when the switch 171 relays and feeds the output data of the second latch 111 to the level shifter 121, as shown in FIG. 5. The switch 161 relays and feeds the positive polarity voltage of the voltage follower 151 to the odd-numbered output terminal 181, and the switch 162 relays and feeds the negative polarity voltage of the voltage follower 152 to the even-numbered output terminal 182. In other words, data or voltage flows in the manner indicated by the broken line in FIG. 5.

On the other hand, since the AC drive control signal POL is a high level H, the switch 172 relays and feeds the output data of the second latch 111 to the level shifter 122 when the switch 171 is switched and relays and feeds the output data of the second latch 112 to the level shifter 121, as shown in FIG. 6. At the same time, the switch 161 relays and feeds a negative polarity voltage of the voltage follower 152 to the odd-numbered output terminal 181, and the switch 162 relays and feeds a positive polarity voltage of the voltage follower 151 to the even-numbered output terminal 182. In other words, data or voltage flows in the manner indicated by the broken line in FIG. 6.

Figure 7:
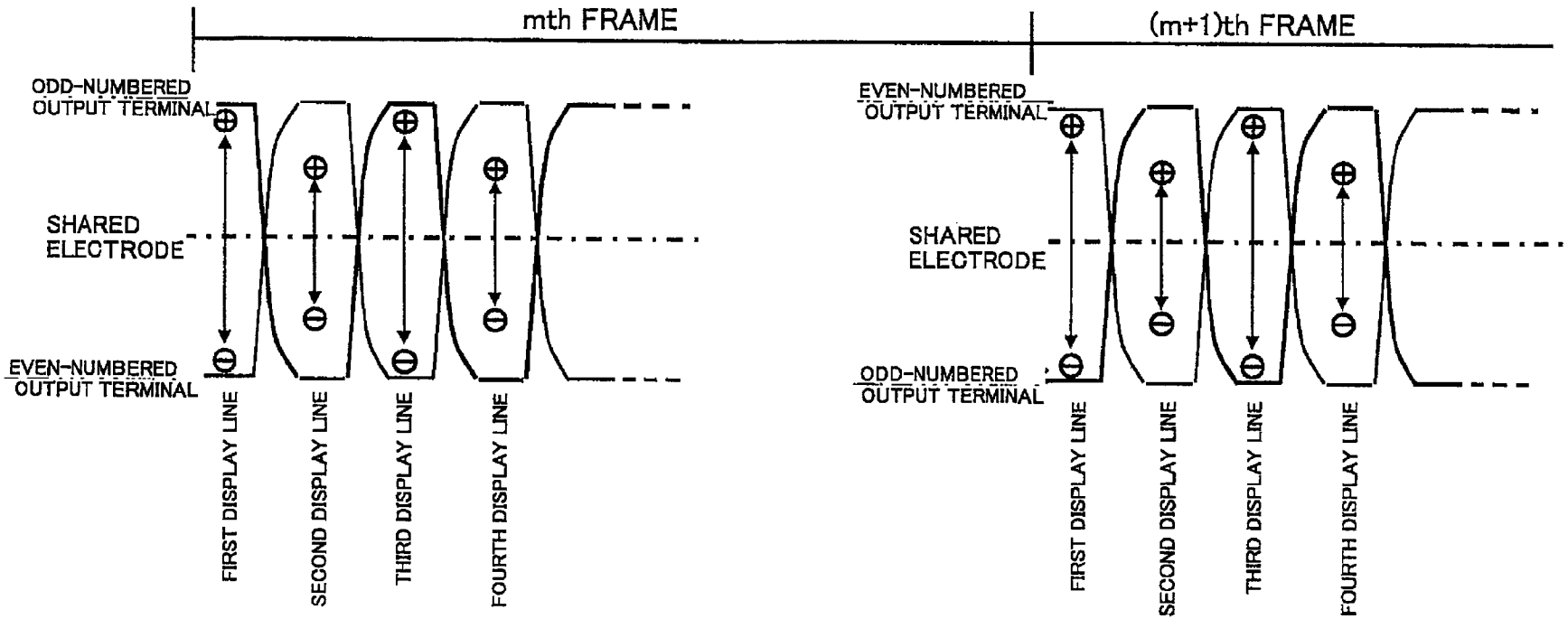
FIG. 7 is a diagram showing the drive voltage waveform of the odd- and even-numbered output terminals of each line scan of the two consecutive frames.

In this manner, the liquid crystal panel 5 can be AC driven by switching the state of FIG. 5 and the state of FIG. 6 in an alternating fashion using the output AC converter switches 161, 162, and 171, 172. The AC converted drive voltage waveform varies for each scan line in each frame in the manner shown in FIG. 7. The odd-numbered output terminal 181 and the even-numbered output terminal 182 constantly apply a positive or negative gradation voltage (drive voltage) in alternating fashion to the shared electrode 55, and perform a positive/negative inversion for each display frame. The same liquid crystal transmittance can thereby be obtained and it is possible to impart positive and negative polarity gradation voltages having equal absolute values of electric potential differences with the shared electrode.

Figure 8:
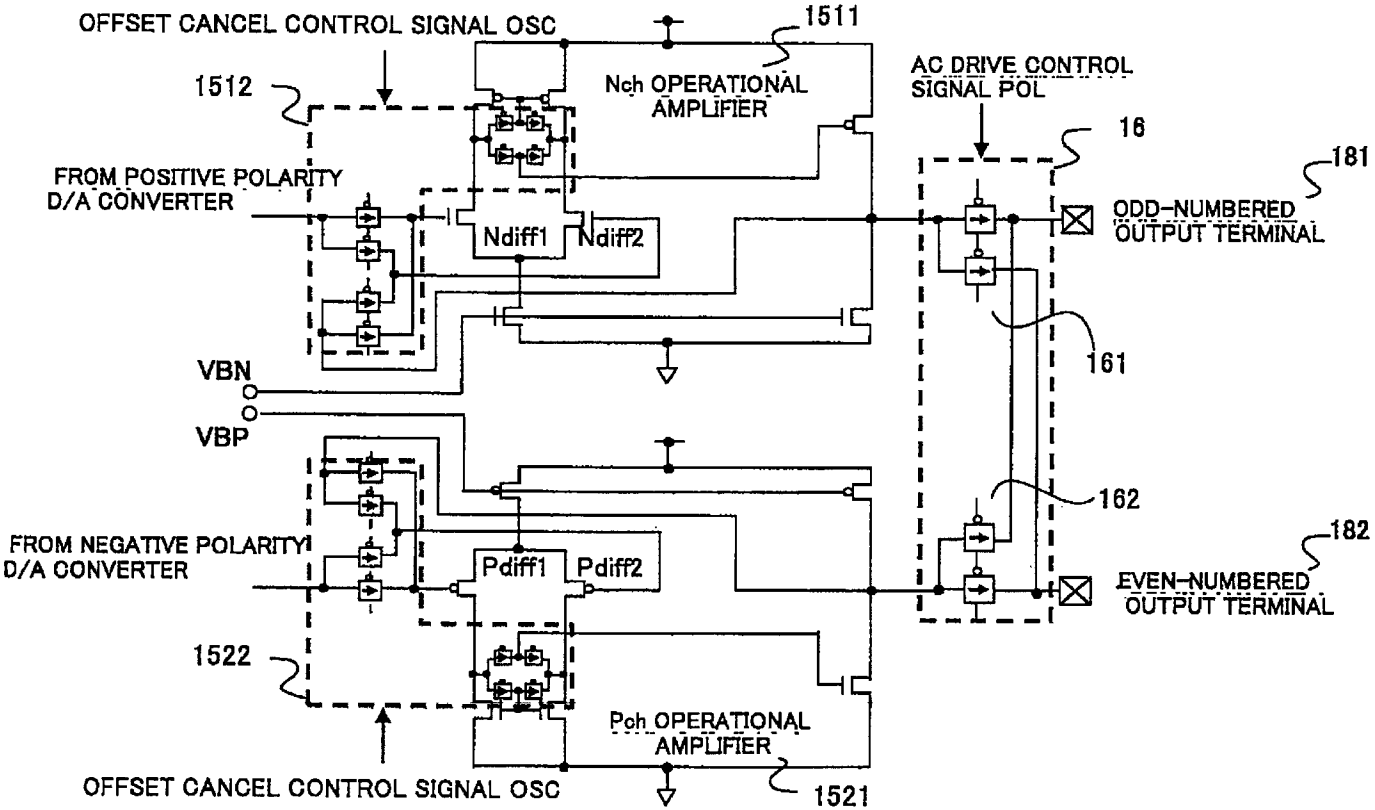
FIG. 8 is a circuit showing each operational amplifier and each switching circuit in the source driver.

In the circuit configuration of FIG. 5 or 6, a single output terminal is constantly connected to the output of the voltage follower 151 when a positive polarity voltage is being outputted, and is constantly connected to the output of the voltage follower 152 when a negative polarity voltage is being outputted. The voltage follower 151 is composed of an N-channel MOS input operational amplifier 1511 (first operation amplifier) and a switching circuit 1512, as shown in FIG. 8. The voltage follower 152 is composed of a P-channel MOS input operation amplifier 1521 (second operational amplifier) and a switching circuit 1522. The switching circuits 1512, 1522 correspond to first switching portion.

Two N-channel MOS transistors Ndiff1 and Ndiff2 are provided for differential inputs in the operational amplifier 1511. The positive polarity gradation voltage (about ½ or more of the voltage of the output voltage of the drive power source 4) from the positive polarity D/A converter 131 is applied to the switching circuit 1512. The switching circuit 1512 selects one of the Ndiff1 and the Ndiff2 as the operational amplifier in-phase input end (positive phase input of the voltage follower 151) in accordance with an offset cancel control signal OSC, and selects the other of the Ndiff1 and the Ndiff2 as an operational amplifier antiphase input end (negative feedback input of the voltage follower 151).

Two P-channel MOS transistors Pdiff1 and Pdiff2 are provided for differential inputs in the operational amplifier 1521. The negative polarity gradation voltage (about ½ or less of the voltage of the output voltage of the drive power source 4) from the positive polarity D/A converter 132 is applied to the switching circuit 1522. The switching circuit 1522 selects one of the Pdiff1 and the Pdiff2 as the operational amplifier in-phase input end (positive phase input of the voltage follower 152) in accordance with an offset cancel control signal OSC, and selects the other of the Pdiff1 and the Pdiff2 as the operational amplifier antiphase input end (negative feedback input of the voltage follower 152).

The AC converter switch 161 feeds the output of the operational amplifier 1511 in accordance with the AC drive control signal POL, i.e., a positive gradation voltage, to one of the odd-numbered output terminal 181 and the even-numbered output terminal 182, and the AC converter switch 162 feeds the output of the operational amplifier 1521 in accordance with the AC drive control signal POL, i.e., a negative gradation voltage, to one of the odd-numbered output terminal 181 and the even-numbered output terminal 182. The AC converter switches 161, 162 correspond to second switching portion.

The offset voltage component is ordinarily included in the gradation voltage as the output voltage due to characteristic differences in terms of manufacturing of the transistors Ndiff1, Ndiff2, Pdiff1, and Pdiff2 in the operational amplifiers 1511, 1521. In view of this fact, a gradation voltage is generated that includes the offset voltage −A in an expected value voltage when the transistor Ndiff1 is selected in the N-channel MOS input operational amplifier 1511 having the configuration shown in FIG. 8, a gradation voltage is generated that includes the offset voltage −A in an expected value voltage when the transistor Ndiff2 is selected, a gradation voltage is generated that includes the offset voltage −B in an expected value voltage when the transistor Pdiff1 is selected in the P-channel MOS input operation amplifier 1521, a gradation voltage is generated that includes the offset voltage −B in an expected value voltage when the transistor Pdiff2 is selected.

Figure 9A:
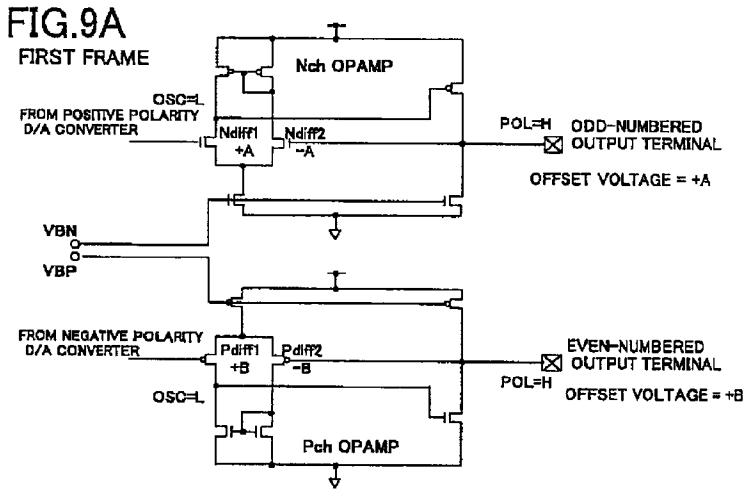
FIGS. 9A to 9D are circuits showing the connection configuration of the operational amplifier that corresponds to the switching state of the switching circuits in each of the first to fourth frames.

The offset cancel control signal OSC is a low level L and the AC drive control signal POL is a high level H in the first frame of four consecutive frames of an input image signal. The output voltage of the positive polarity D/A converter 131 is fed by the switching circuit 1512 to the gate of the transistor Ndiff1 when OSC=L, and the gate of the transistor Ndiff2 is connected to the output of the operational amplifier 1511, as shown in FIG. 9A. The output voltage of the negative polarity D/A converter 132 is furthermore fed by the switching circuit 1522 to the gate of the transistor Pdiff1 and the gate of the transistor Pdiff2 is connected to the output of the operation amplifier 1521. The output of the operational amplifier 1511 is connected by the AC converter switch 161 to the odd-numbered output terminal 181 when POL=H, and the output of the operation amplifier 1521 is connected by the AC converter switch 162 to the even-numbered output terminal 182. Accordingly, the offset voltage +A is included in the gradation voltage generated at the odd-numbered output terminal 181, and the offset voltage +B is included at the even-numbered output terminal 182.

Figure 9B:
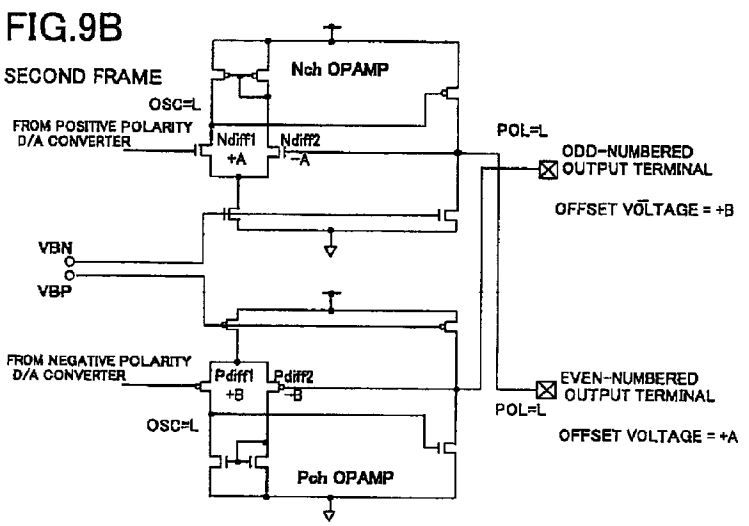

In the second frame, the offset cancel control signal OSC is a low level L and the AC drive control signal POL is a low level L. The output voltage of the positive polarity D/A converter 131 is fed by the switching circuit 1512 to the gate of the transistor Ndiff1 when OSC=L, and the gate of the transistor Ndiff2 is connected to the output of the operational amplifier 1511, as shown in FIG. 9B. The output voltage of the negative polarity D/A converter 132 is furthermore fed by the switching circuit 1522 to the gate of the transistor Pdiff1 and the gate of the transistor Pdiff2 is connected to the output of the operation amplifier 1521. The output of the operational amplifier 1511 is connected by the AC converter switch 161 to the even-numbered output terminal 182 when POL=L, and the output of the operation amplifier 1521 is connected by the AC converter switch 162 to the odd-numbered output terminal 181. Accordingly, the offset voltage +B is included in the gradation voltage generated at the odd-numbered output terminal 181, and the offset voltage +A is included at the even-numbered output terminal 182.

Figure 9C:
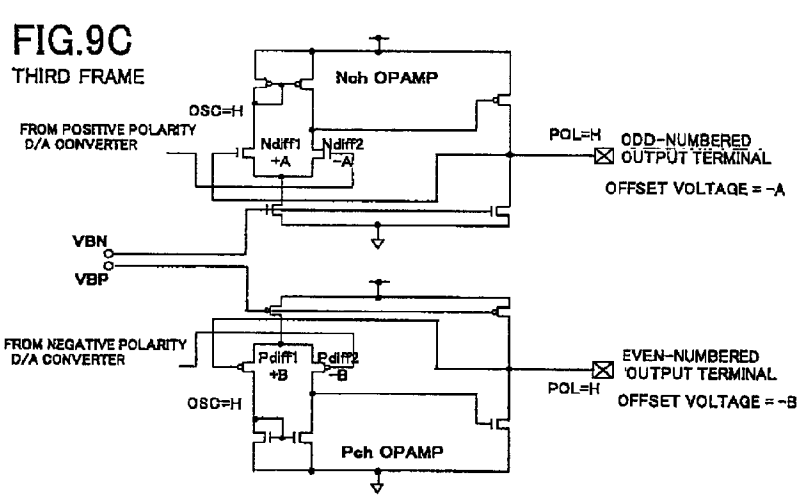

In the third frame, the offset cancel control signal OSC is a high level H and the AC drive control signal POL is a high level H. The output voltage of the positive polarity D/A converter 131 is fed by the switching circuit 1512 to the gate of the transistor Ndiff2 when OSC=H, and the gate of the transistor Ndiff1 is connected to the output of the operational amplifier 1511, as shown in FIG. 9C. The output voltage of the negative polarity D/A converter 132 is furthermore fed by the switching circuit 1522 to the gate of the transistor Pdiff2 and the gate of the transistor Pdiff1 is connected to the output of the operation amplifier 1521. The output of the operational amplifier 1511 is connected by the AC converter switch 161 to the odd-numbered output terminal 181 when POL=H, and the output of the operation amplifier 1521 is connected by the AC converter switch 162 to the even-numbered output terminal 182. Accordingly, the offset voltage −A is included in the gradation voltage generated at the odd-numbered output terminal 181, and the offset voltage −B is included at the even-numbered output terminal 182.

Figure 9D:
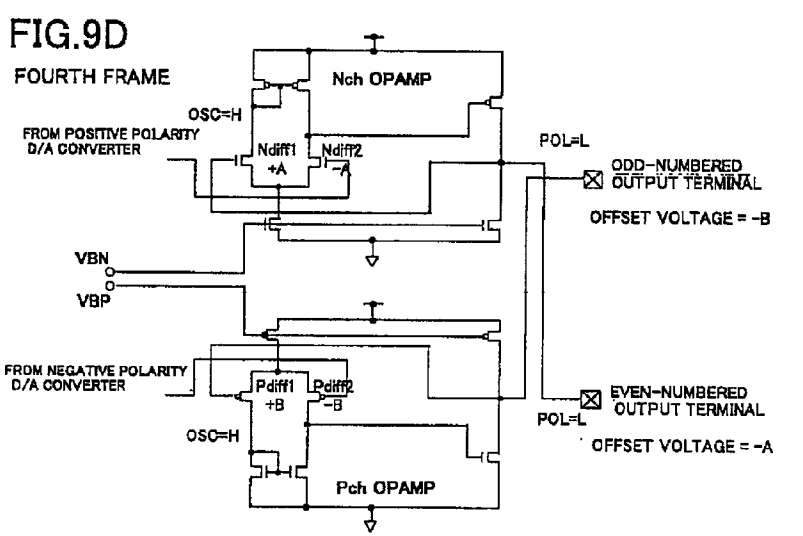

In the fourth frame, the offset cancel control signal OSC is a high level H and the AC drive control signal POL is a low level L. The output voltage of the positive polarity D/A converter 131 is fed by the switching circuit 1512 to the gate of the transistor Ndiff2 when OSC=H, and the gate of the transistor Ndiff1 is connected to the output of the operational amplifier 1511, as shown in FIG. 9D. The output voltage of the negative polarity D/A converter 132 is furthermore fed by the switching circuit 1522 to the gate of the transistor Pdiff2 and the gate of the transistor Pdiff1 is connected to the output of the operation amplifier 1521. The output of the operational amplifier 1511 is connected by the AC converter switch 161 to the even-numbered output terminal 182 when POL=H, and the output of the operation amplifier 1521 is connected by the AC converter switch 162 to the odd-numbered output terminal 181. Accordingly, the offset voltage −B is included in the gradation voltage generated at the odd-numbered output terminal 181, and the offset voltage −A is included at the even-numbered output terminal 182.

Based on the above description, the relationship between L, H of the AC drive control signal POL and the polarity of the drive voltage outputted by the odd-numbered and even-numbered output terminals is noted in TABLE 1.

TABLE 1

| AC drive control signal POL | Odd-numbered output terminals | Even-numbered output terminals |
|---|---|---|
| L | Positive polarity voltage output | Negative polarity voltage output |
| H | Negative polarity voltage output | Positive polarity voltage output |

The relationship between offset cancel control signal and the offset voltages of the transistors Ndiff1, Ndiff2 of the operational amplifier 1511 and the transistors Pdiff1, Pdiff2 the operation amplifiers 1521 is noted in TABLE 2.

TABLE 2

| Operational Amplifier | Differential input transistor | Offset voltage | Offset cancel control signal OSC |
|---|---|---|---|
| Nch operational amplifier 1511 | Ndiff1 | +A | L |
| | Ndiff2 | −A | H |
| Pch operational amplifier 1521 | Pdiff1 | +B | L |
| | Pdiff2 | −B | H |

Figure 10:
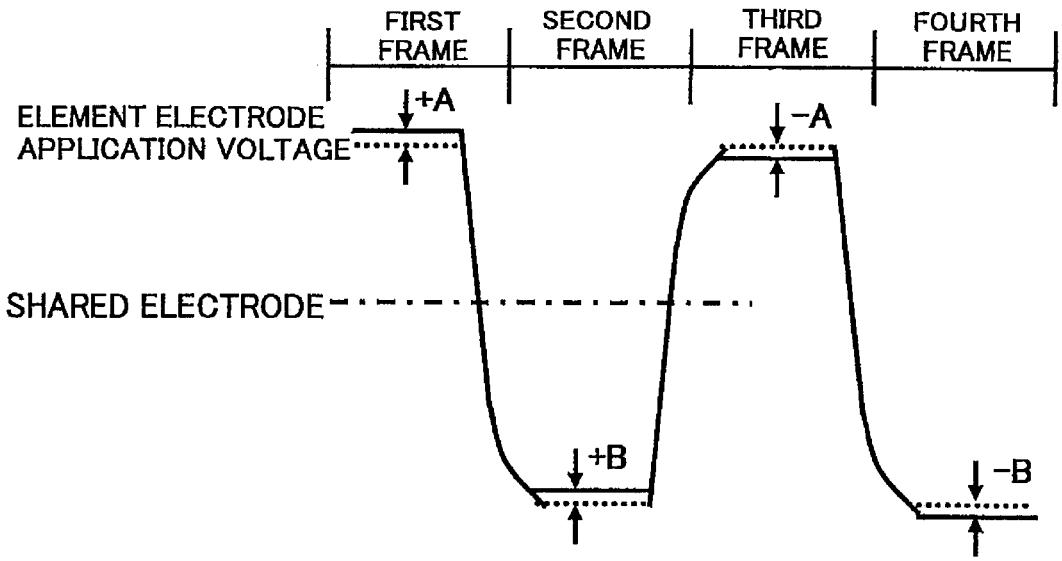
FIG. 10 is a diagram for describing the offset process of the offset voltage in the first to fourth frames.

For example, in a cell positioned in a gate signal line 53 on the source signal line 52 connected to the odd-numbered output terminal 181, a gradation voltage that includes the offset voltage +A is applied in the first frame, a gradation voltage that includes the offset voltage +B is applied in the second frame, a gradation voltage that includes the offset voltage −A is applied in the third frame, and a gradation voltage that includes the offset voltage −B is applied in the fourth frame, as shown in FIG. 10. The offset voltages in the first to fourth frames cancel each other in the manner of +A+B−A−B=0. Since the operation of the fourth frame is repeated, the offset voltage component is canceled in four frame cycles. Accordingly, nonuniformity in display cannot be discerned by the viewer's eyes and a quality display can be achieved.

Figure 11:
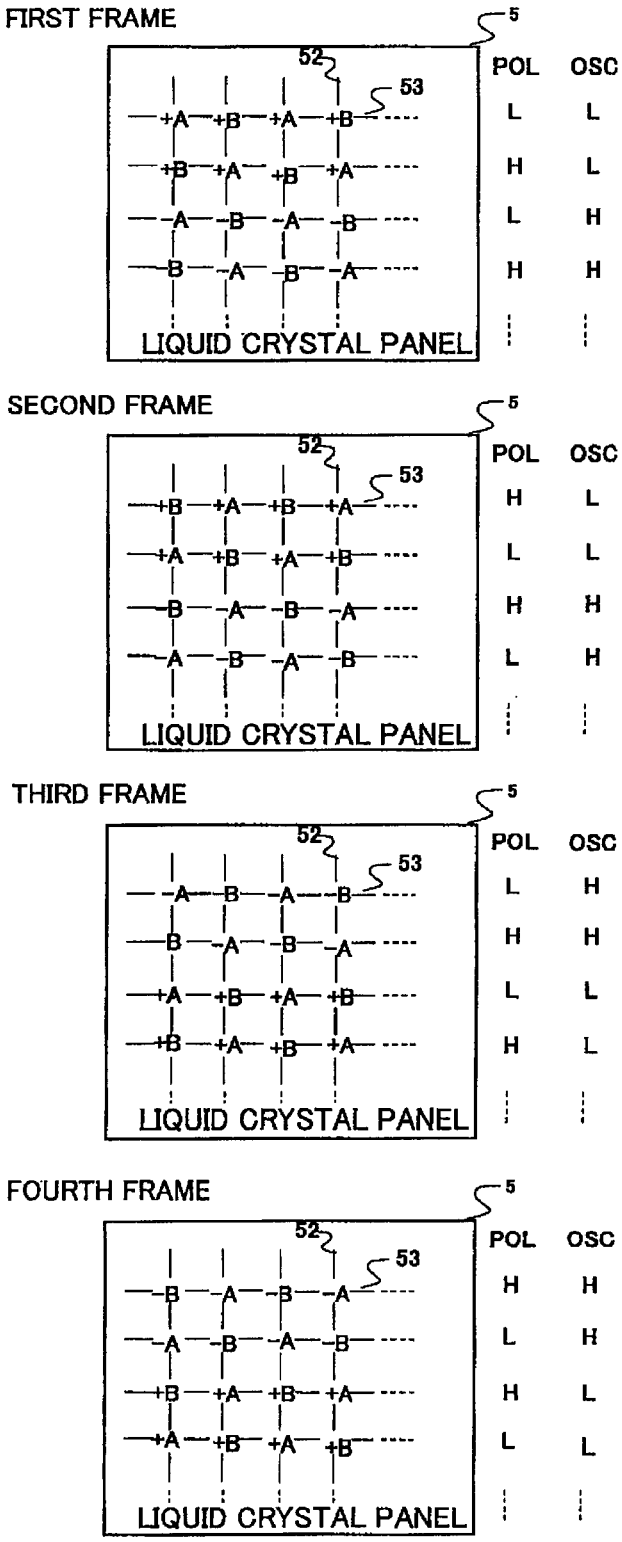
FIG. 11 is a diagram showing the offset voltage in the drive voltage of each cell in the first to fourth frames using the dot inversion drive scheme.
Figure 12:
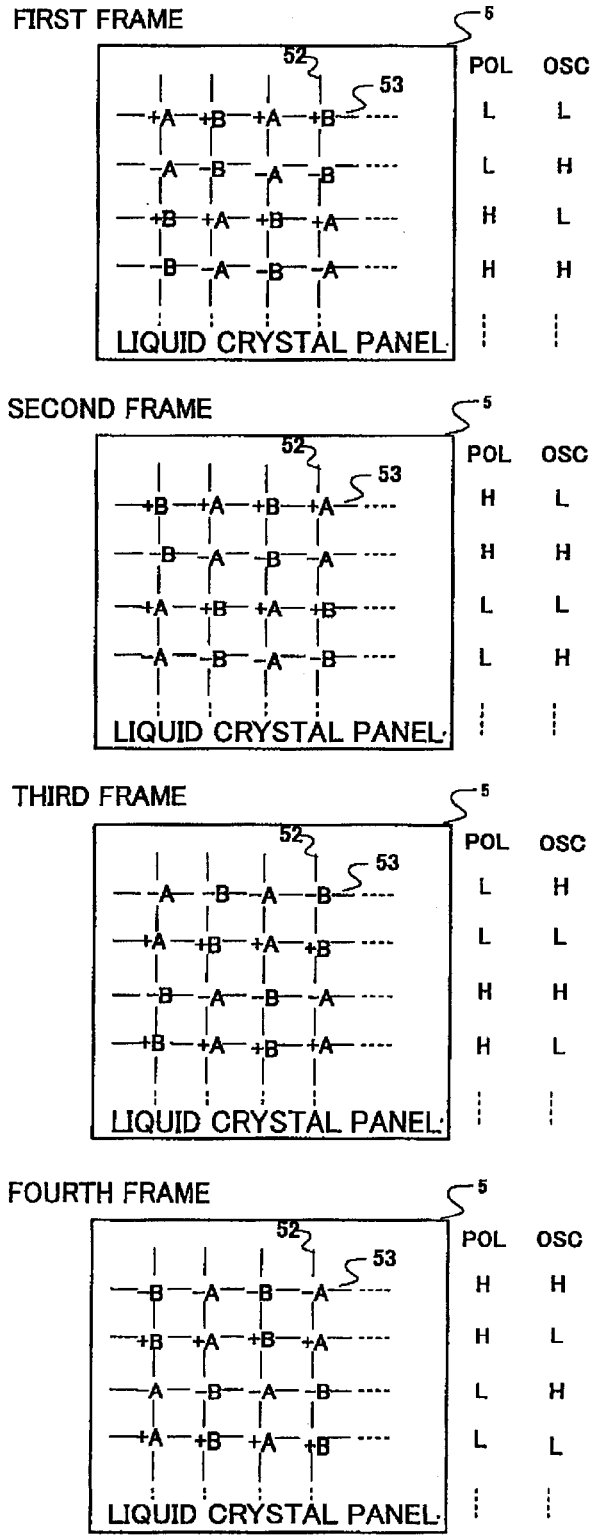
FIG. 12 is a diagram showing the offset voltage in the drive voltage of each cell in the first to fourth frames using the two-line dot inversion drive scheme.

FIG. 11 shows the offset voltage of each cell in the liquid crystal panel 5 in the case that offset cancelling is carried out every four frames in the dot inversion drive scheme. FIG. 12 shows the offset voltage of each cell of the liquid crystal panel 5 in the case that the offset is canceled out every four frames in the two-line dot inversion drive scheme.

The switching circuits 1512, 1522 thus must be controlled in accordance with the offset cancel control signal OSC in order to cancel the offset every four frames.

The OSC generation circuit for generating the offset cancel control signal OSC will be described next. The OSC generation circuit is a circuit formed inside the source drivers 2.

Figure 13:
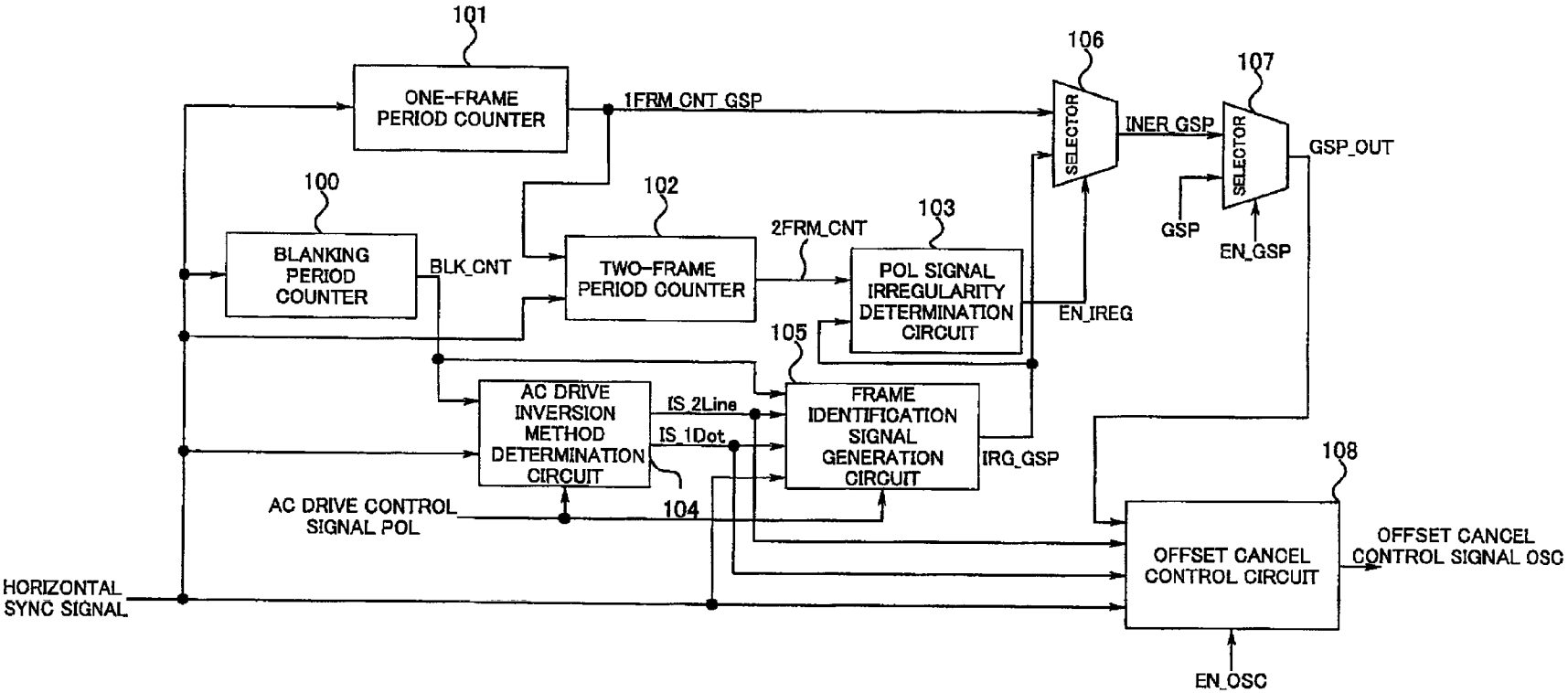
FIG. 13 is a block diagram showing the configuration of the OSC generation circuit inside the source driver.

The OSC generation circuit is provided with a blanking period counter 100, a one-frame period counter 101, a two-frame period counter 102, a POL signal irregularity determination circuit 103, an AC drive inversion method determination circuit 104, a frame identification signal generation circuit 105, a selector 107, and an offset cancel control circuit 108, as shown in FIG. 13.

A horizontal synchronization signal is fed to the blanking period counter 100, the one-frame period counter 101, the two-frame period counter 102, the AC drive inversion method determination circuit 104, the frame identification signal generation circuit 105, and the offset cancel control circuit 108.

The blanking period counter 100 counts the pulses of the inputted horizontal synchronization signal (horizontal synchronization pulses) and generates a signal BLK_CNT that expresses the blanking period of the image signal. The signal BLK_CNT is used for outputting a single pulse in relation to the rise or fall of a predetermined number of cycles of the horizontal synchronization signal. For example, a single output is made for the input of 64 horizontal synchronization signals in the case of a 6-bit counter.

The one-frame period counter 101 counts the horizontal synchronization pulses of the inputted horizontal synchronization signal and generates a signal 1FRM_CNT_GSP that expresses one frame period (including the blanking period) of the image signal. The two-frame period counter 102 divides the frequency of the output signal of the one-frame period counter 101 to obtain two frame periods of the output signal, counts the number of horizontal synchronization pulses in the two frame periods, and generates a signal 2FRM_CNT that expresses a 2-frame period. While it is preferred that one frame period including the blanking period be set based on the information of the timing controller, it is also possible to artificially substitute 1080 cycles in the case of full HD, for example. It is also possible to consider using 1024 cycles of a 10-bit counter when providing an even simpler configuration.

The AC drive inversion method determination circuit 104 receives as input a horizontal synchronization signal, a signal BLK_CNT that expresses a blanking period, and a AC drive control signal POL, and determines the method of the AC drive control signal POL. The dot inversion drive scheme or the two-line dot inversion drive scheme is determined as the method. In the case of the dot inversion drive scheme, an output signal IS_1DOT is a high level H indicating true, and an output signal IS_2Line is a low level L indicating false. In the case of the two-line dot inversion-drive scheme, the output signal IS_1DOT is a low level L indicating false, and an output signal IS_2Line is a high level H indicating true. The input of a predetermined number of cycles of the signal BLK_CNT is used as the determination period, and after the determination period has elapsed, the IS_1DOT and IS_2Line are fixed and lower power consumption can be achieved by stopping the determination operation.

The frame identification signal generation circuit 105 receives the horizontal synchronization signal, the signal BLK_CNT expressing the blanking period, the output signal IS_1DOT, and the output signal IS_2Line, and based on these signals, the frame identification signal IRG_GSP (pseudo vertical synchronization signal) is generated indicating the time at which the pulse of the vertical synchronization signal (vertical synchronization pulse) is generated. In other words, the irregularity of the AC drive control signal POL in the blanking period is detected in accordance with the signal BLK_CNT that expresses the blanking period, thereby generating the frame identification signal IRG_GSP. The irregularity of the AC drive control signal POL is described later. The frame identification signal IRG_GSP is fed to the POL signal irregularity determination circuit 103 and a selector 106. It is also possible that the irregularity of the AC drive control signal POL is detected a plurality of times in one blanking period and that several changes will exist in the frame identification signal IRG_GSP. In such a case, only the irregularity of the first AC drive control signal POL is outputted as the frame identification signal IRG_GSP. This can be implemented using the one-frame period counter to fix the predetermined period output of the counter portion on the basis of the irregularity of the first AC drive control signal POL.

The POL signal irregularity determination circuit 103 accepts as input an output signal 2FRM_CNT of the two-frame period counter 102 and the output signal IRG_GSP of the frame identification signal generation circuit 105, and generates a high level H switching signal EN_IREG when the AC drive control signal POL is irregularly generated. The irregular generation of the AC drive control signal POL is determined by detecting variation of the frame identification signal IRG_GSP in a predetermined period. In this case, the reason that the output signal_2FRM_CNT of the two-frame period counter 102 is used as input is that at least two frames are required in the period for determining that irregularity does not exist. The irregularity will be described later. In the case that the determination of irregularity of the AC drive control signal POL has ended, low power consumption is made possible by fixing the output and ending the determination operation in the same manner as the AC drive inversion method determination circuit 104.

A frame identification signal IRG_GSP is outputted to the selector 107 as INER_GSP in place of the signal 1FRM_CNT_GSP when the selector 106 outputs the signal 1FRM_CNT_GSP of the one-frame period counter 101 to the selector 107 as INER_GSP, and a high level H switching signal EN_IREG is fed from the POL signal irregularity determination circuit 103.

In addition to the output signal INER_GSP of the selector 106, a vertical synchronization signal GSP and an enable signal EN_GSP are fed from the exterior to the selector 107. In the case that the enable signal EN_GSP is false and the vertical synchronization signal GSP is fed from the exterior and received, the selector 107 outputs the vertical synchronization signal GSP to the offset cancel control circuit 108 as a vertical synchronization signal GSP_OUT. In the case that the enable signal EN_GSP is true, the vertical synchronization signal GSP is not received, and the selector 107 therefore outputs the output signal INER_OUT of the selector 106 as GSP_OUT to the offset cancel control circuit 108. The selector 107 is not particularly required to be provided in the case that an input terminal for the vertical synchronization signal GSP is not provided to the IC chip of the source drivers 2, but the selector 107 is provided as a general-use source driver regardless of the existence of the input terminal.

In addition to the horizontal synchronization signal, the output signal IS_1DOT, the output signal IS_2Line, the output signal GSP_OUT of the selector 107, and the offset cancel enable signal EN_OSC are fed to the offset cancel control circuit 108. The offset cancel control circuit 108 synchronizes the output signal GSP_OUT of the selector 107 as the vertical synchronization signal with the horizontal synchronization signal, and generates the offset cancel control signal OSC. The case of the dot inversion drive scheme and the case of the two-line dot inversion drive scheme are differentiated in accordance with the output signals IS_1DOT and the IS_2Line when the offset cancel control signal OSC is generated. The offset cancel enable signal EN_OSC is a signal for enabling the offset cancel control circuit 108 to carry out an offset cancel control operation. In the examples, the offset cancel control operation is enabled in accordance with the offset cancel enable signal EN_OSC.

Here, the irregularity of the AC drive control signal POL will be described. The AC drive control signal POL is outputted from the timing controller 1 in synchronization with the horizontal synchronization signal, is a signal in which a low level L and a high level H are repeated, and is also generated in the blanking period. However, there are four types of blanking periods of the image signal. In other words, the pulse count of the horizontal synchronization signal in the blanking periods can be divided into [four types:] 4n+3, 4n+2, 4n+1, 4n (wherein n is an integer of 0 or higher).

FIGS. 14A to 14D shows an example of the change in the AC drive control signal POL and the change in the offset cancel control signal OSC synchronized with the horizontal synchronization signal in the cases of 4n+3, 4n+2, 4n+1, 4n in the dot inversion drive scheme in which one frame has four gate signal lines.

The relationship between the AC drive control signal POL, the offset cancel control signal OSC, and the offset voltage included in the drive voltage outputted to the odd-numbered and even-numbered output terminals is noted in TABLE 3.

TABLE 3

| AC drive control signal POL | Offset cancel control signal OSC | Offset voltage of odd-numbered output | Offset voltage of even-numbered output |
|---|---|---|---|
| L | L | +A | +B |
| | H | −A | −B |
| H | L | +B | +A |
| | H | −B | −A |

As shown in FIGS. 14A to 14D, the AC drive control signal POL repeats LH inversion in the manner of L, H, L, H, . . . in synchronization with the horizontal synchronization signal. The offset cancel control signal OSC repeats the inversion of 2 L and 2 H in the manner of L, L, H, H, . . . in synchronization with the horizontal synchronization signal. The regular inversion operation is thus referred to as a free-run operation because of the offset cancellation. FIGS. 14A to 14D show the variation of the offset cancel control signal OSC and the AC drive control signal POL synchronized with the horizontal synchronization signal of the blanking period between frames. However, the AC drive control signal POL begins from a high level H in the subsequent second frame in the case that the start was from a low level L in the first frame. In the third frame, the level starts from a low level L, and in the fourth frame the level starts from a high level H. Accordingly, in each of the second frame through the fifth frame in the case of 4n+2 of FIG. 14B and in the case of 4n of FIG. 14D, the AC drive control signal POL continues at the same level from the end of the blanking period to the start of the frame period indicated by the broken line. This is the irregularity of the AC drive control signal POL.

FIGS. 15A to 15D show an example of the change in the AC drive control signal POL and the change in the offset cancel control signal OSC synchronized with the horizontal synchronization signal in the cases of 4n+3, 4n+2, 4n+1, 4n in the two-line dot inversion drive scheme in which one frame has four gate signal lines. In each of these cases, the AC drive control signal POL repeats inversion of 2 L and 2 H in the manner of L, L, H, H, . . . in synchronization with the horizontal synchronization signal. The offset cancel control signal OSC repeats LH inversion in the manner of L, H, L, H, . . . in synchronization with the horizontal synchronization signal. This is also the free-run operation described above. FIGS. 15A through 15D as well show the variation of the offset cancel control signal OSC and the AC drive control signal POL synchronized with the horizontal synchronization signal of the blanking period between frames. However, the AC drive control signal POL begins from a high level H in the subsequent second frame in the case that the start was from a low level L in the first frame in the same manner as the dot inversion drive scheme. In the third frame, the level starts from a low level L, and in the fourth frame the level starts from a high level H. Accordingly, in each of the second frame through the fifth frame in the case of 4n+3 of FIG. 15A and in the case of 4n of FIG. 15D, the AC drive control signal POL continues at the same level from the end of the blanking period to the start of the frame period indicated by the broken line. Also, when the AC drive control signal POL enters the frame period in the case of 4n+1 of FIG. 15C, the level inverts after a single L level or a single H level in the blanking period in the portion indicated by a broken line. This is the irregularity of the AC drive control signal POL.

The frame period cannot be determined in the case that a vertical synchronization signal is not inputted in this manner. Therefore, cancellation in four frame cycles of the offset voltage component described above cannot be properly carried out.

In order to respond to this situation, the irregularity of the AC drive control signal POL is detected in the OSC generation circuit of FIG. 13. In other words, the frame identification signal generation circuit 105 can determine the end of the blanking period and the start of the next frame in accordance with the signal BLK_CNT expressing the blanking period fed from the blanking period counter 100, and can determine the whether the AC drive control signal POL is a signal of the dot inversion drive scheme or the two-line dot inversion drive scheme in accordance with the output signal IS_1DOT and the output signal IS_2Line. Therefore, the occurrence of the irregularity described above can be determined by monitoring the AC drive control signal POL in accordance with horizontal synchronization signal. When the irregularity of the AC drive control signal POL is detected, the frame identification signal generation circuit 105 generates a frame identification signal IRG_GSP at the time of the vertical synchronization pulse of the vertical synchronization signal in the blanking period.

The POL signal irregularity determination circuit 103 generates a high level H switching signal EN_IREG when the AC drive control signal POL is determined to be irregular in accordance with the output signal 2FRM_CNT of the two-frame period counter 102 and the output signal IRG_GSP of the frame identification signal generation circuit 105. The switching signal EN_IREG is fed to the selector 106, and when the enable signal ENG_GSP is false, the frame identification signal IRG_GSP is fed to the offset cancel control circuit 108 as GSP_OUT via the selectors 106, 107 in place of the signal 1FRM_CNT_GSP that indicates one frame.

The offset cancel control signal OSC is generated in the offset cancel control circuit 108 in synchronization with the horizontal synchronization signal using the output signal GSP_OUT of the selector 107 as the vertical synchronization signal.

For example, the level of the offset cancel control signal OSC changes in the manner shown in FIGS. 16A and 16B in accordance with the AC drive control signal POL merely synchronized with the horizontal synchronization signal in the cases of 4n+2 and 4n in the dot inversion drive scheme in which one frame has four gate signal lines.

Figures 17A, 17B, 17C:
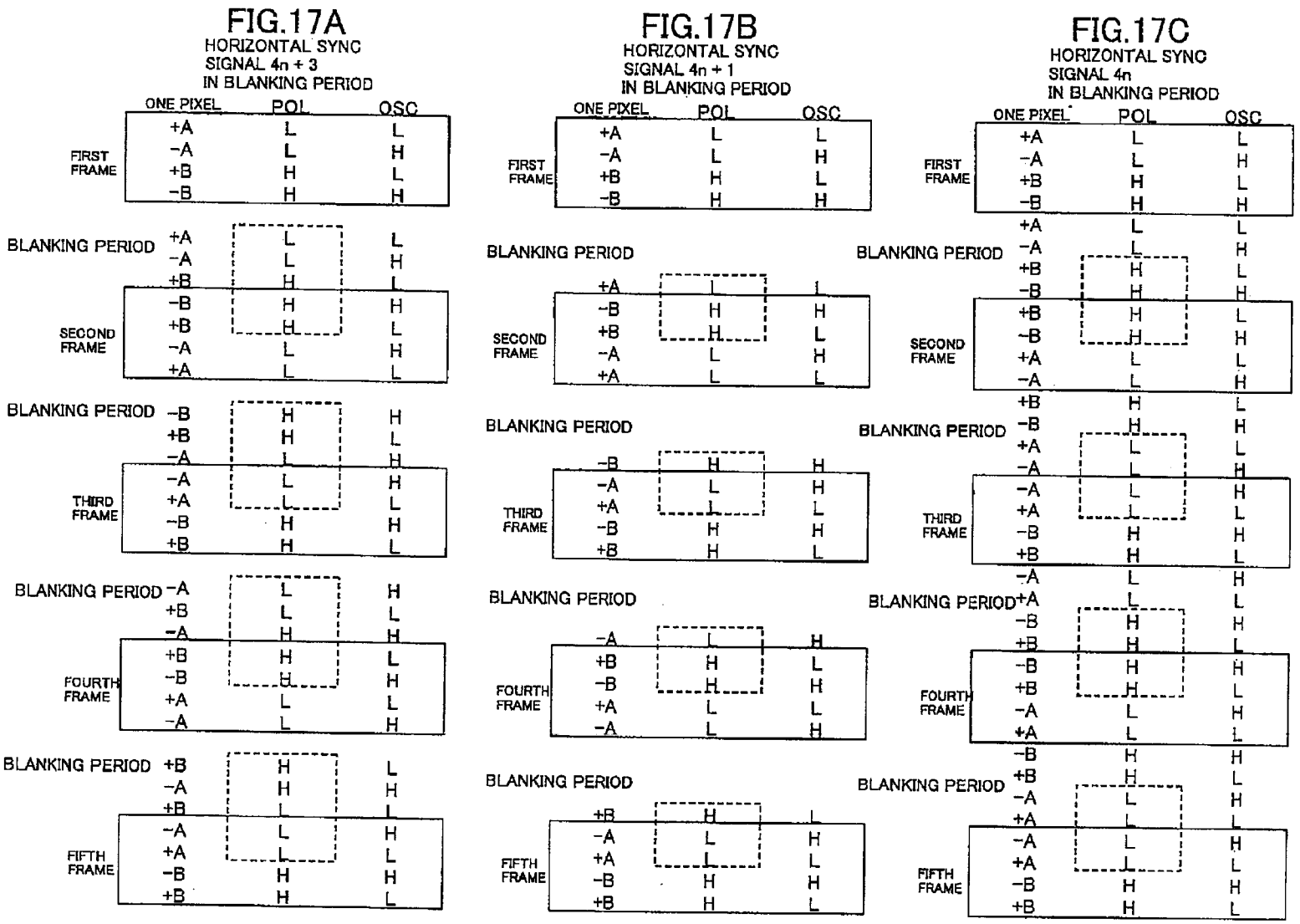
FIGS. 17A to 17C are diagrams showing the variation of the offset cancel control signal OSC and the variation of the offset voltage when the frame identification signal is used as the pseudo vertical synchronization signal using the two-line dot inversion drive scheme.

Similarly, the level of the offset cancel control signal OSC changes in the manner shown in FIGS. 17A through 17C in accordance with the AC drive control signal POL merely synchronized with the horizontal synchronization signal in the cases of 4n+3, 4n+1, and 4n in the two-line dot inversion drive scheme in which one frame has four gate signal lines.

The offset voltages in the four frames cancel each other in the manner of +A+B−A−B=0. In other words, offset cancelling can be carried out every four frames.

In this manner, offset cancellation can be carried out every four frames in accordance with the offset cancel control signal OSC in the case that irregularity of the AC drive control signal POL has been detected, even when a vertical synchronization signal is not fed to the source driver 2. The offset voltage between the display frames can be canceled without increasing the cost of the print board on which the source drivers are mounted and a good quality display is made possible in which nonuniformity in display is not discerned by the viewer's eyes even in an existing liquid crystal panel in which a vertical synchronization signal GSP is not inputted to the source drivers 2.

Figures 14A, 14B, 14C, 14D:
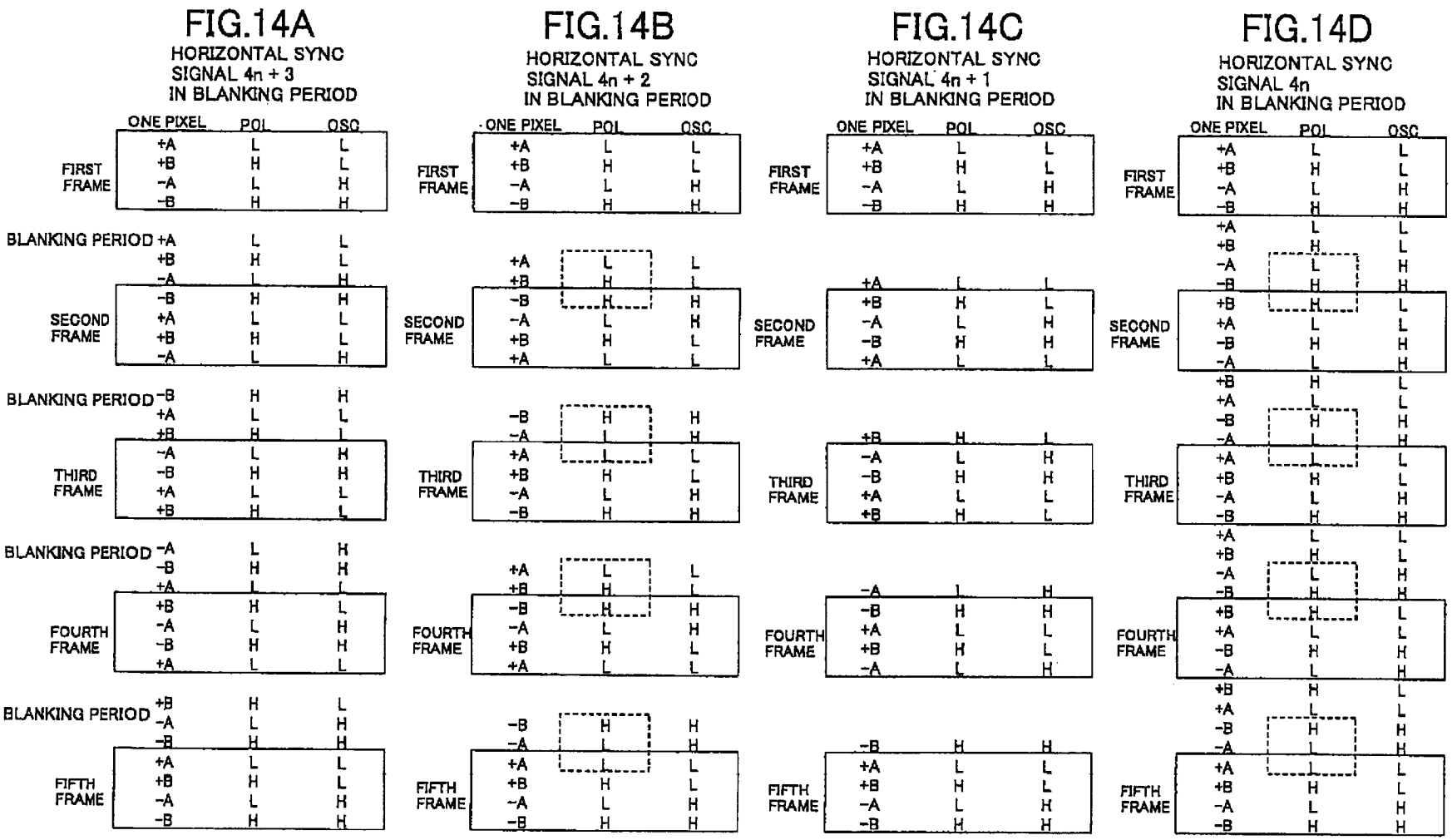
FIGS. 14A to 14D are diagrams showing an example of the variation of the AC drive control signal POL, the variation of the offset cancel control signal OSC synchronized with the horizontal synchronization signal, and the variation of the offset voltage, in five consecutive frames using the dot inversion drive scheme.

On the other hand, in the case that irregularity of the AC drive control signal POL is not detected in the dot inversion drive scheme, the switching signal EN_IREG is a low level L indicating false in the case of 4n +3 of FIG. 14A and in the case of 4n+1 of FIG. 14C, for example. In this case, even when the enable signal EN_GSP is false and an external vertical synchronization signal can be inputted, the vertical synchronization signal is not fed and a state is brought about in which the output signal GSP_OUT of the selector 107 is not present. For example, the pathway from the selector 107 to the offset cancel control circuit 108 may be blocked in accordance with the details of the irregularity of the AC drive control signal POL determined in the frame identification signal generation circuit 105.

Accordingly, the offset cancel control circuit 108 generates a regular offset cancel control signal OSC using only the horizontal synchronization signal and the output signal IS_1DOT or the output signal IS_2Line to obtain a free-run operation. The low level L and the high level H of the offset cancel control signal OSC are sequentially inverted every two lines in the manner shown in FIGS. 14A and 14C. In other words, the levels are not required to be kept at the same level midway across four lines, as shown in FIGS. 16A and 16B.

In this manner, the offset cancel control signal OSC can be allowed a free run in the case that irregularity of the AC drive control signal POL is not detected and even when a vertical synchronization signal is not fed to the source drivers 2. Therefore, offset cancellation can be carried out every four frames. The offset voltage between the display frames can be canceled without increasing the cost of the print board on which the source drivers are mounted and a good quality display is made possible in which nonuniformity in display is not discerned by the viewer's eyes, even in an existing liquid crystal panel in which a vertical synchronization signal GSP is not inputted to the source drivers 2.

Figure 15A:
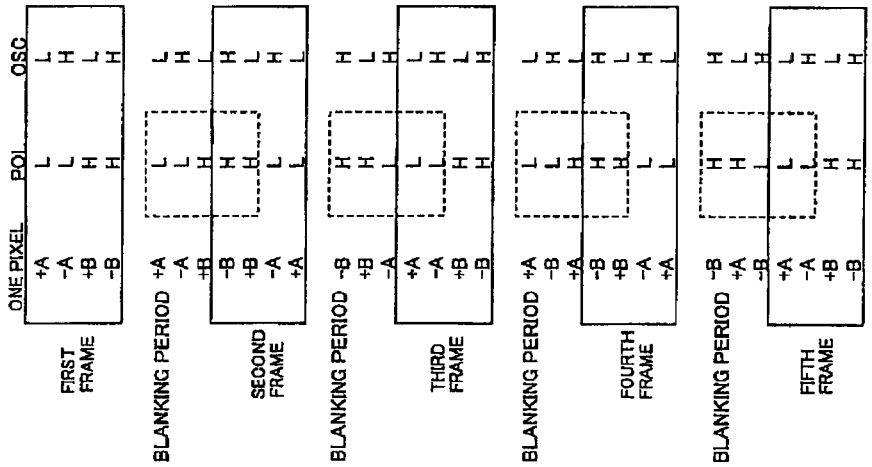
FIGS. 15A to 15D are diagrams showing an example of the variation of the AC drive control signal POL, the variation of the offset cancel control signal OSC synchronized with the horizontal synchronization signal, and the variation of the offset voltage, in five consecutive frames using the two-line dot inversion drive scheme.
Figure 15B:
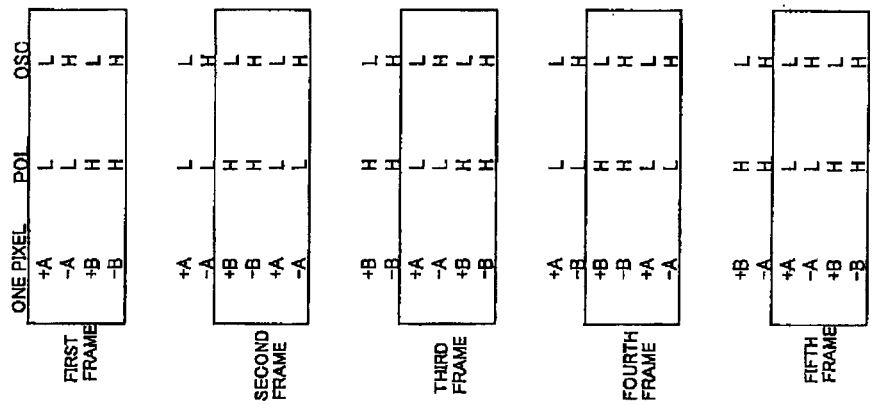
Figure 15C:
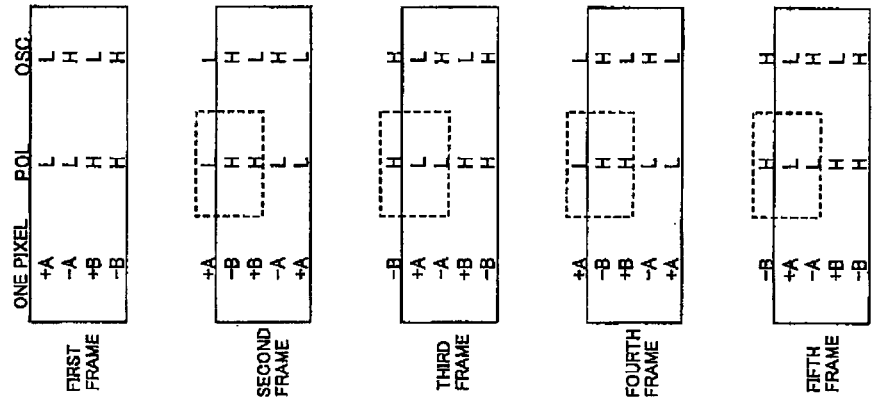
Figure 15D:
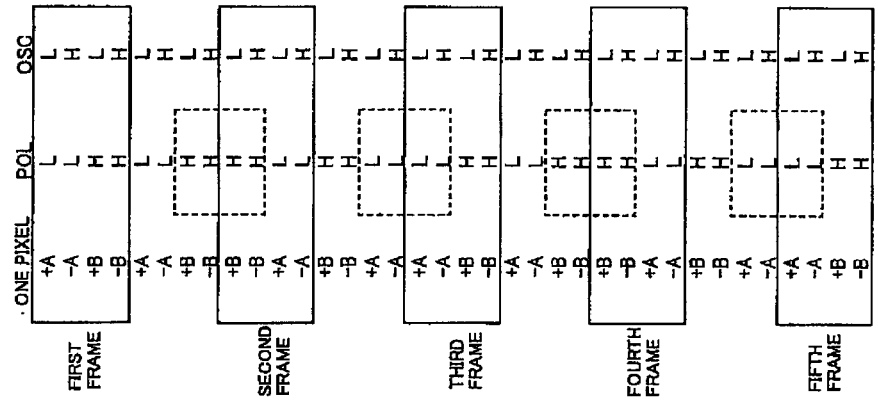

In another case in which irregularity of the AC drive control signal POL is not detected in the two-line dot inversion drive scheme, the switching signal EN_IREG is a low level L indicating false in the case of 4n+2 of FIG. 15B, for example. In this case, the signal 1FRM_CNT_GSP expressing one frame period from the one-frame period counter 101 is fed to the offset cancel control circuit 108 as GSP_OUT via the selectors 106, 107. In the offset cancel control circuit 108, the output signal GSP_OUT of the selector 107, i.e., the signal 1FRM_CNT_GSP is used as the vertical synchronization signal and the offset cancel control signal OSC is generated in synchronization with horizontal synchronization signal. The signal 1FRM_CNT_GSP can be regarded as a pseudo vertical synchronization signal that is equivalent to a vertical synchronization signal because a period that is equal to the frame period + the blanking period is generated by counting the horizontal synchronization pulses.

For example, the level of the offset cancel control signal OSC is varied in the manner of FIG. 18 in accordance with the AC drive control signal POL merely synchronized with the horizontal synchronization signal in the case of 4n+2 in the two-line dot inversion drive scheme in which one frame has four gate signal lines.

Accordingly, in another case in which irregularity of the AC drive control signal POL is not detected, offset cancellation can be performed every four frames because a signal equal to the vertical synchronization signal is generated by counting the horizontal synchronization signal in the frame period (including the blanking period), even when a vertical synchronization signal is not fed to the source drivers 2. The display frames can be identified and the offset voltage between the display frames can be canceled without increasing the cost of the print board on which the source drivers are mounted and a good quality display is made possible in which nonuniformity in display is not discerned by the viewer's eyes, even in an existing liquid crystal panel in which a vertical synchronization signal GSP is not fed to the source drivers 2.

Described in the examples above is a device for generating the same timing signal as a vertical synchronization signal using an irregular AC drive control signal POL that is fed from a general-use timing controller, but the present invention is not limited to a AC drive control signal POL, and application can be made to all irregular control signals fed to the source drivers. Also described in the examples are a dot inversion drive scheme and a two-line dot inversion drive scheme, but application can also be made to a plural-line dot inversion drive scheme of three or more lines, a horizontal two-dot inversion drive scheme, or other drive schemes.

The present invention is not limited to a liquid crystal panel, and application can also be made to a source driver of organic EL display panels, or other display panels.

This application is based on Japanese Application No. 2008-142462, which is incorporated herein by reference.

What is claimed is:

1. A drive control method in a source driver for receiving from a timing controller a horizontal synchronization signal of an image signal and a binary control signal of which a value varies in two values for each one line or two lines of a display panel in synchronization with said horizontal synchronization signal and in which start values of adjacent frames of said image signal are different, excluding a vertical synchronization signal of said image signal, so as to apply drive voltages to a plurality of source signal lines of the display panel, the drive voltages each having a polarity corresponding to a value of the binary control signal, the drive control method comprising:

a blanking period determining step of determining a blanking period of said image signal on the basis of a pulse count of said horizontal synchronization signal and generating a signal indicative of the blanking period;

a step of determining whether an AC (alternating current) drive inversion method is a dot inversion drive scheme in which the value of the binary control signal varies for each one line, or a two-line dot inversion drive scheme in which the value of the binary control signal varies for each two lines, in accordance with said horizontal synchronization signal, a result of the determination of said blanking period, and said binary control signal;

a pseudo vertical synchronization signal generation step of generating a pseudo vertical synchronization signal indicative of one frame period including the blanking period of said image signal by counting the number of pulses of said horizontal synchronization signal; and an offset cancel step of performing a cancel operation of an offset voltage component of each of said drive voltages on the basis of said horizontal synchronization signal, said pseudo vertical synchronization signal, the determination result of said blanking period, and a result of the determination of said AC drive inversion method, so that the offset voltage component is canceled even if said AC drive inversion method is either the dot inversion drive scheme or the two-line dot inversion drive scheme.

2. The drive control method according to claim 1, wherein the cancel operation of said offset voltage component is carried out for each four or more vertical cycles as a single unit in said offset cancel step.

3. The drive control method according to claim 1, wherein said source driver comprises:

a first operational amplifier having first and second transistors for differential inputs, wherein a drive voltage including a first offset voltage is generated when an input signal corresponding to said image signal is fed to said first transistor, and a drive voltage including a second offset voltage whose polarity is opposite that of said first offset voltage is generated when an input signal corresponding to said image signal is fed to said second transistor;

a second operational amplifier having third and fourth transistors for differential inputs, wherein a drive voltage including a third offset voltage is generated when an input signal corresponding to said image signal is fed to said third transistor, and a drive voltage including a fourth offset voltage whose polarity is opposite that of said third offset voltage is generated when an input signal corresponding to said image signal is fed to said fourth transistor;

a first switching portion which switches an input/output relationship between said first transistor and said second transistor of said first operational amplifier, and an input/output relationship between said third transistor and said fourth transistor of said second operational amplifier; and a second switching portion which switches between an output of said first operational amplifier and an output of said second operational amplifier in accordance with said binary control signal to connect the switched outputs to two source signal lines, wherein an offset cancel control signal for instructing a switching operation for each frame is fed to said first switching portion in accordance with said pseudo vertical synchronization signal so that said first to fourth offset voltages are canceled in four frames of said image signal in said offset cancel step.

4. The drive control method according to claim 3, wherein when said pseudo vertical synchronization signal is not generated in said pseudo vertical synchronization signal generation step, said offset cancel control signal is generated in said offset cancel step on the basis of said horizontal synchronization signal so that said first switching portion performs the switching operation in a predetermined sequence.

5. The drive control method according to claim 1, wherein said pseudo vertical synchronization signal generation step has a step of determining on the basis of the determination result of said blanking period whether a value indicated by said binary control signal has varied with a predetermined regularity, and said pseudo vertical synchronization signal is generated on the basis of said binary control signal when it is determined that the value indicated by said binary control signal has not varied with the predetermined regularity.

6. A source driver for receiving from a timing controller a horizontal synchronization signal of an image signal and a binary control signal of which a value varies in two values for each one gate signal line or two gate signal lines of a display panel in synchronization with said horizontal synchronization signal and in which start values of adjacent frames of said image signal are different, excluding a vertical synchronization signal of said image signal, so as to apply drive voltages to a plurality of source signal lines of the display panel, the drive voltages each having a polarity corresponding to a value of the binary control signal, the source driver comprising:

a blanking period determining portion which determines a blanking period of said image signal on the basis of a pulse count of said horizontal synchronization signal and generates a signal indicative of the blanking period;

a portion which determines whether an AC drive inversion method is a dot inversion drive scheme in which the value of the binary control signal varies for each one line, or a two-line dot inversion drive scheme in which the value of the binary control signal varies for each two lines, in accordance with said horizontal synchronization signal, a result of the determination of said blanking period, and said binary control signal;

a pseudo vertical synchronization signal generation portion which generates a pseudo vertical synchronization signal indicative of one frame period including the blanking period of said image signal by counting the number of pulses of said horizontal synchronization signal; and an offset cancel portion which performs a cancel operation of an offset voltage component of each of said drive voltages on the basis of said horizontal synchronization signal, said pseudo vertical synchronization signal, the determination result of said blanking period, and a result of the determination of said AC drive inversion method, so that the offset voltage component is canceled even if said AC drive inversion method is either the dot inversion drive scheme or the two-line dot inversion drive scheme.

7. The source driver according to claim 6 further comprising:

a first operational amplifier having first and second transistors for differential inputs, wherein a drive voltage including a first offset voltage is generated when an input signal corresponding to said image signal is fed to said first transistor, and a drive voltage including a second offset voltage whose polarity is opposite that of said first offset voltage is generated when an input signal corresponding to said image signal is fed to said second transistor;

a second operational amplifier having third and fourth transistors for differential inputs, wherein a drive voltage including a third offset voltage is generated when an input signal corresponding to said image signal is fed to said third transistor, and a drive voltage including a fourth offset voltage whose polarity is opposite that of said third offset voltage is generated when an input signal corresponding to said image signal is fed to said fourth transistor;

a first switching portion which switches an input/output relationship between said first transistor and said second transistor of said first operational amplifier, and an input/output relationship between said third transistor and said fourth transistor of said second operational amplifier; and a second switching portion which switches between an output of said first operational amplifier and an output of said second operational amplifier in accordance with said binary control signal to connect the switched outputs to two source signal lines, wherein said offset cancel portion instructs a switching operation of said first switching portion for each frame so that said first to fourth offset voltages are canceled in four frames of said image signal.

8. The source driver according to claim 7, wherein when said pseudo vertical synchronization signal is not generated in said pseudo vertical synchronization signal generation portion, said offset cancel portion generates an offset cancel control signal on the basis of said horizontal synchronization signal so that said first switching portion performs the switching operation in a predetermined sequence.

9. The source driver according to claim 6, wherein said pseudo vertical synchronization signal generation portion has a portion which determines on the basis of the determination result of said blanking period whether a value indicated by said binary control signal has varied with a predetermined regularity, and generates said pseudo vertical synchronization signal on the basis of said binary control signal when it is determined that the value indicated by said binary control signal has not varied with the predetermined regularity.

* * * * *